US005375358A

United States Patent [19]

Riness et al.

[11] Patent Number: 5,375,358

[45] Date of Patent: Dec. 27, 1994

[54] QUICK MUZZLE LOADING RIFLE AND LOADER

[75] Inventors: Jay D. Riness; Floyd A. Haskill, both of Woodstock, Ga.

[73] Assignee: Riness Arms, Inc., Woodstock, Ga.

[21] Appl. No.: 61,204

[22] Filed: May 13, 1993

Related U.S. Application Data

[63] Continuation-in-part of Ser. No. 899,608, Jun. 16, 1992, abandoned.

[51] Int. Cl.[5] ..... F41C 7/06; F41C 27/00

[52] U.S. Cl. ..... 42/27; 42/1.07; 42/32; 42/90; 221/88

[58] Field of Search ..... 42/1.07, , 27, 32, 33, 42/39.5, 51, 60, 61, 78, 90, 106; 89/13.05, 13.1, 26; 221/87, 88, 122

[56] References Cited

U.S. PATENT DOCUMENTS

| | | | |
|---|---|---|---|
| Re. 1,693 | 6/1864 | Moore | 42/61 |
| 15,144 | 6/1856 | North | 42/61 |
| 18,472 | 10/1857 | Skinner et al. | 42/27 |
| 46,125 | 1/1865 | Milbank | 42/27 |
| 570,458 | 11/1896 | Coston | 42/51 |
| 4,137,663 | 2/1979 | Farber | 42/51 |
| 5,081,781 | 1/1992 | Kanyuck et al. | 42/90 |

FOREIGN PATENT DOCUMENTS

| | | | |
|---|---|---|---|
| 3016 | of 1856 | United Kingdom | 42/27 |
| 1723 | of 1860 | United Kingdom | 42/27 |

OTHER PUBLICATIONS

Information Disclosure Statement filed Sep. 30, 1992 for U.S. application Ser. No. 07/899,608.

*Primary Examiner*—Stephen C. Bentley
*Attorney, Agent, or Firm*—Louis T. Isaf

[57] ABSTRACT

A Quick Muzzle Loading Rifle is provided that consists of a barrel extension that is threaded into a frame and a short barrel that is pivotally attached to the frame and can pivot between a position in-line with the barrel extension and a position to the side of the frame. When pivoted to the side of the frame, the short barrel is loaded. Once loaded, the short barrel is placed in-line with and forced toward the barrel extension which causes the short barrel to contact a gas seal that ensures leak-tight communication between the short barrel and the barrel extension. While in this configuration, the Quick Muzzle Loading Rifle is capable of being fired. A Quick Loader functions to load the Quick Muzzle Loading Rifle and consists of a main cylinder, a cylinder top, and a cylinder base. The main cylinder bounds, in its interior, a plurality of cylindrical storage cavities. The cylinder base bounds a mating structure and a single cylindrical hole which is capable of being lined up individually with each of the plurality of storage cavities in the main cylinder. The cylinder top attachment houses a spring-loaded ramrod mechanism which is always in-line with the hole in the cylinder base attachment. The Quick Loader is loaded by filling the storage cavities with black powder and lead balls. The cylinder base is mated to the short barrel and the ramrod mechanism is actuated to load the Quick Muzzle Loading Rifle.

17 Claims, 12 Drawing Sheets

QUICK MUZZLE LOADING RIFLE AND LOADER

CROSS-REFERENCE TO RELATED APPLICATIONS

This application is a continuation-in-part of application Ser. No. 07/899,608, filed Jun. 16, 1992, and abandoned.

BACKGROUND OF THE INVENTION

The present invention relates generally to firearms and, in its most preferred embodiment, to black powder, muzzle loading rifles.

Conventional black powder, muzzle loading rifles are an extremely popular choice among those who use rifles. The ammunition for black powder, muzzle loading rifles is less expensive than that for more modern rifles; some people consider them to be more nostalgic than modern rifles; and they are classified as "primitive" for hunting purposes, therefore, persons who use them are often allowed special hunting privileges.

There are, however, some limitations with the conventional black powder, muzzle loading rifle. Loading the rifle can be cumbersome because powder must first be deposited down the rifle barrel; then a patch and ball must be started into the barrel; and finally a long ramrod must be forced down the entire length of the barrel to pack the black powder, patch, and ball in the breech end of the barrel. Each time the conventional black powder, muzzle loading rifle is fired, it must be reloaded by repeating the entire loading process. The loading process can be especially difficult and aggravating in certain situations; for example, if an individual is hunting and has missed the target with his first shot, seldom can he expect to get a second shot at the target due to the extended length of time required to reload. Also, it can be nearly impossible to reload a conventional muzzle loading rifle while hunting from a treestand due to space limitations. Also, most conventional black powder muzzle loading rifles are heavy; therefore, it can be difficult for people of smaller stature or lighter weight to properly handle a conventional black powder muzzle loading rifle. Also, the contact between the rifling of a conventional black powder muzzle loading rifle and a lead ball shot by it is limited. As a result, when a conventional black powder muzzle loading rifle is fired there is gas leakage around the lead ball which decreases the lead ball velocity and less spin is imparted on the lead ball which decreases the accuracy of its trajectory.

There is a need, therefore, for a lightweight, muzzle loading rifle, with improved rifling, that can be quickly and easily reloaded.

SUMMARY OF THE INVENTION

Briefly described, the preferred embodiment of the present invention provides a black powder, muzzle loading rifle, and an accompanying loader, that facilitate quick and easy loading and reloading.

The rifle of the present invention consists of a rifled barrel extension, referred to hereafter as the barrel extension, threaded into a frame. The rifle further includes a shoulder stock to which the frame is attached in a manner that seeks to preclude the splitting of the shoulder stock. The rifle frame defines a cavity for housing a short barrel which is similar to the barrel extension. However, the short barrel is much shorter, is not rifled, has a bore which tapers to a smaller diameter towards a breech end, and has a breech plug. The short barrel swings between two positions; one within the rifle frame cavity, and the other out to the side of the rifle frame. The short barrel is releasably locked within the rifle frame cavity by a cam mechanism associated with the rifle frame. When the short barrel is locked within the rifle frame by the cam mechanism, the short barrel centerline is collinear with the barrel extension centerline. When the cam mechanism is disengaged, springs force the short barrel to swing out to the side of the rifle frame where it is easily loaded. The short barrel is, preferably, manually returned to its position within the frame cavity.

When the short barrel is locked within the frame, a tight seal between the short barrel and the barrel extension is ensured by the cam mechanism and a beveled gas seal. The cam mechanism applies force to the breech end of the short barrel and drives it forward toward the frame end of the barrel extension. The muzzle end of the short barrel is beveled and comes into contact with the beveled gas seal which is threaded into the rifle frame in a position between the short barrel and the barrel extension. The integrity of the gas seal can be further ensured by adjusting the effective short barrel length. This adjustment is made by rotating a gas seal adjuster that is connected to the breech end of the short barrel. This adjustment ensures that the cam mechanism securely forces the short barrel against the gas seal. Adjustment may be necessary to diminish looseness between components that can result from manufacturing or extended use of the rifle.

While the short barrel is pivoted away from the rifle centerline, it is, preferably, loaded quickly and easily by the loader of the present invention. This loading is accomplished by aligning a discharge cavity of the loader with the muzzle end of the short barrel and pressing a lever. Black powder and a lead ball are so injected into the short barrel that the lead ball wedges into the tapered bore of the short barrel and the black powder is properly encased between the lead ball and the breech plug. After the short barrel is loaded, it is pushed back into the frame cavity and securely locked into position by engaging the cam mechanism. Once the short barrel is loaded and locked into position, the rifle is fired in a manner that is typical to conventional muzzle loading rifles.

The loader consists, in part, of a main cylinder, a cylinder top, and cylinder base. These elements are connected to each other by a shaft that runs through the center of the main cylinder. The cylinder top and bottom are rigidly attached to the shaft such that they rotate relative to the main cylinder, but not relative to each other. The main cylinder bounds, in its interior, a plurality of cylindrical storage cavities which have diameters slightly larger than the lead balls shot in the rifle. These storage cavities are the length of the main cylinder and the centerlines of all of the storage cavities are parallel to and equal distances from the centerline of the main cylinder.

The cylinder base attachment is a circular plate of the same diameter as the main cylinder. The cylinder base attachment bounds a single cylindrical hole which is so oriented that when the cylinder base is rotated relative to the main cylinder, the hole will line up with each of the plurality of storage cavities in the main cylinder individually. Also, the diameter of the hole in the cylinder base is identical to the diameter of the storage cavities in the main cylinder. The cylinder base also includes an extension that fits over the muzzle end of the short barrel and supports the loader such that the hole in the cylinder base is in-line with the short barrel bore.

The cylinder top attachment is a circular plate of the same diameter as the main cylinder. Housed within and above the cylinder top attachment is a spring-loaded ramrod mechanism which is always in-line with the hole in the cylinder base attachment due to the rigid attachment between the cylinder top and base attachments. If the ramrod is cocked and aligned with a storage cavity in the main cylinder, then a lever is pressed to release the ramrod so that the ramrod spring forces it to discharge the contents of the storage cavity out through the hole defined by the cylinder base. Thus, when the storage cavity in the main cylinder is properly loaded with black powder and a ball, and the base of the loader is mated to the short barrel, the contents of the storage cavity are thereby loaded into the loading muzzle.

The loading process can be repeated until the loader is depleted by re-cocking the ramrod and rotating the main cylinder to orient the ramrod above another loaded storage cavity. While the ramrod is cocked it does not extend into a storage cavity and therefore does not interfere with rotation of the main cylinder. The main cylinder can be physically rotated after pressing the indexer lock. The indexer lock releases and locks the main cylinder and also aids in aligning the ramrod with storage cavities.

It is, therefore, an object of the present invention to provide a muzzle loading rifle that can be quickly and easily reloaded.

Another object of the present invention is to provide a muzzle loading rifle that has a short barrel that breaks away from the barrel extension to simplify loading.

Yet another object of the present invention is to provide a muzzle loading rifle with a short barrel, a barrel extension, and a mechanism for securing the short barrel to the barrel extension such that leakage is minimized between the two when the rifle is fired.

Still another object of the present invention is to provide for the adjustment of the effective length of the short barrel.

Still another object of the present invention is to provide for the adjustment of the alignment of the short barrel relative to the barrel extension.

Still another object of the present invention is to provide a muzzle loading rifle with rifling that is similar to the rifling of breech loaded rifles.

Still another object of the present invention is to provide a unique method for loading and reloading a muzzle loading rifle.

Still another object of the present invention is to provide a muzzle loading rifle that delivers a lead ball with greater velocity and spin than conventional muzzle loading rifles.

Still another object of the present invention is to provide a loader that can be used in combination with a muzzle loading rifle to quickly and easily reload the rifle.

Still another object of the present invention is to provide a unique muzzle loading rifle system comprising combined cooperation of a muzzle loaded rifle and loader.

Still another object of the present invention is to provide a loader that can quickly reload a muzzle loading rifle multiple times.

Still another object of the present invention is to provide a loader that can reload a muzzle loading rifle multiple times, wherein the rifle has a short barrel that separates from and can be reengaged to a barrel extension.

Other objects, features and advantages of the present invention will become apparent upon reading and understanding this specification, when taken in conjunction with the accompanying drawings.

DETAILED DESCRIPTION OF THE PREFERRED EMBODIMENT

The Quick Muzzle Loading Rifle

Figure 1:
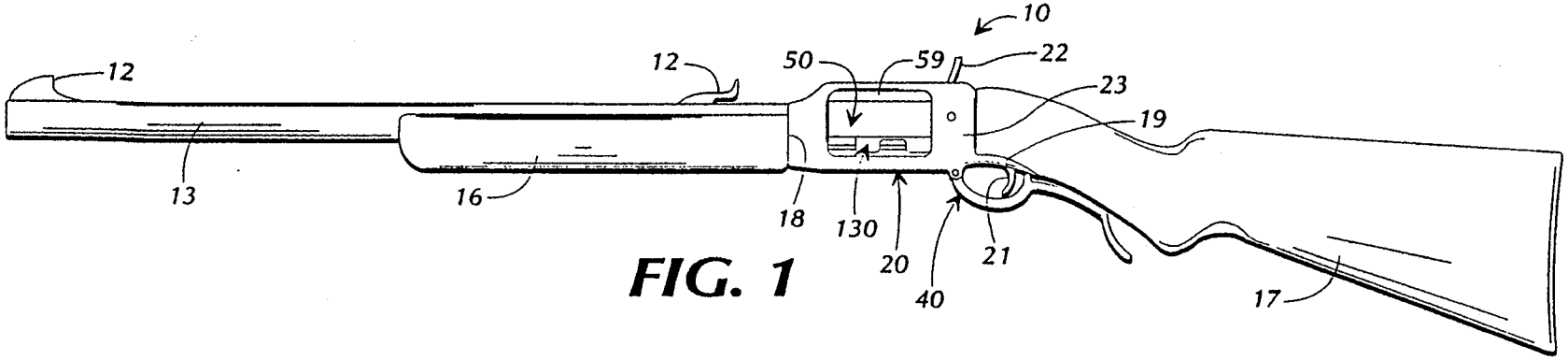
FIG. 1 is a side view of a Quick Muzzle Loading Rifle in accordance with the preferred embodiment of the present invention, shown in an engaged condition.

Referring now in greater detail to the drawings, in which like numerals represent like components throughout the several views, a side view of a Quick Muzzle Loading Rifle 10, in accordance with the preferred embodiment of the present invention, is shown in FIG. 1 in the engaged condition. The Quick Muzzle Loading Rifle 10 includes a frame 20 which defines a short barrel cavity 59, a frame front 18, a frame middle 23, and a frame rear 19. A butt stock 17 (referred to hereafter as a shoulder stock) is connected to and conceals a large portion of the frame rear 19. A barrel extension 13 is connected to the frame front 18 and a forearm 16 is connected to the barrel extension 13. A pair of sights 12 are also connected to the barrel extension 13. The Quick Muzzle Loading Rifle 10 is also seen to include an oscillator mechanism 130 (for lack of a better term we have chosen to call this the oscillator mechanism) and a short barrel 50. The oscillator mechanism 130 is connected to the frame front 18 and frame middle 23, and the short barrel 50 is connected to the oscillator mechanism 130. A portion of a cam mechanism 40 is shown connected to the frame middle 23. A trigger 21 and a hammer 22 are connected to the frame rear 19 and frame middle 23, respectively.

Figure 2:
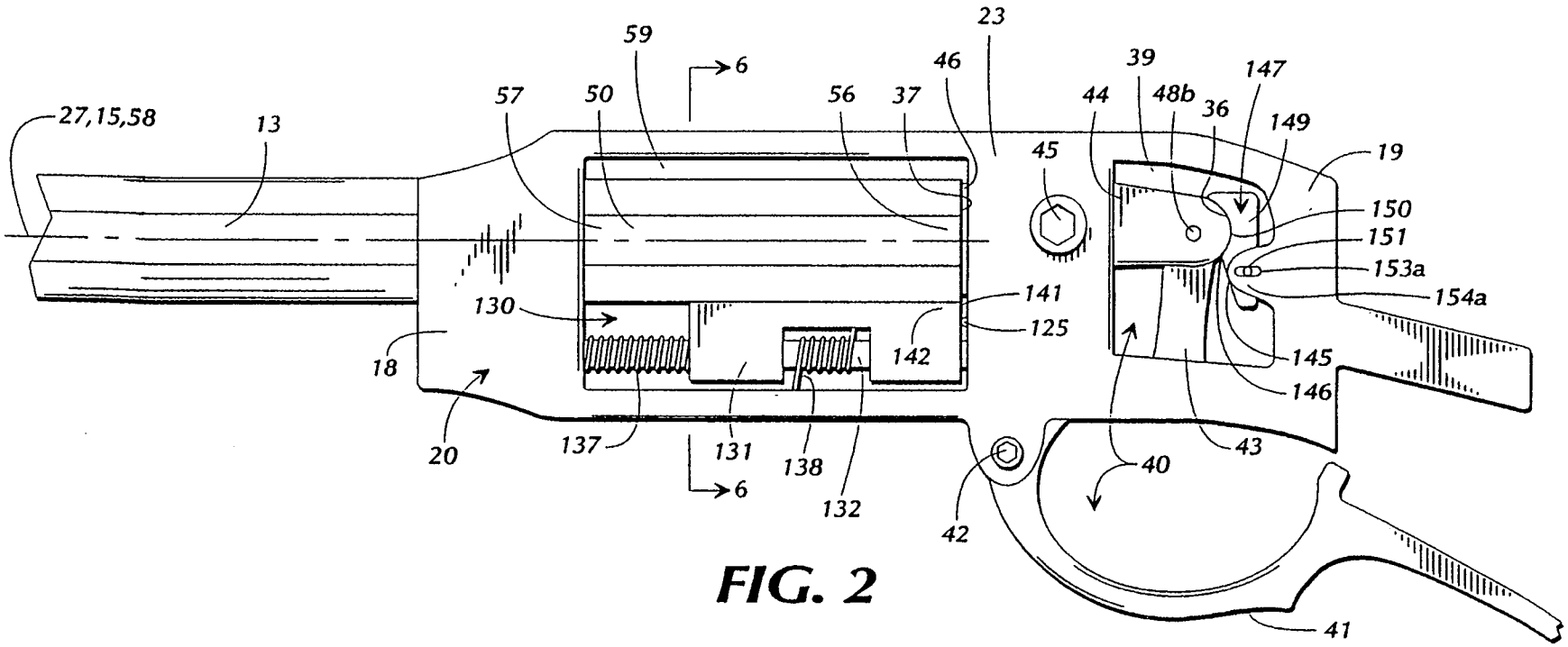
FIG. 2 is a side view of portions of the Quick Muzzle Loading Rifle of FIG. 1.
Figure 3:
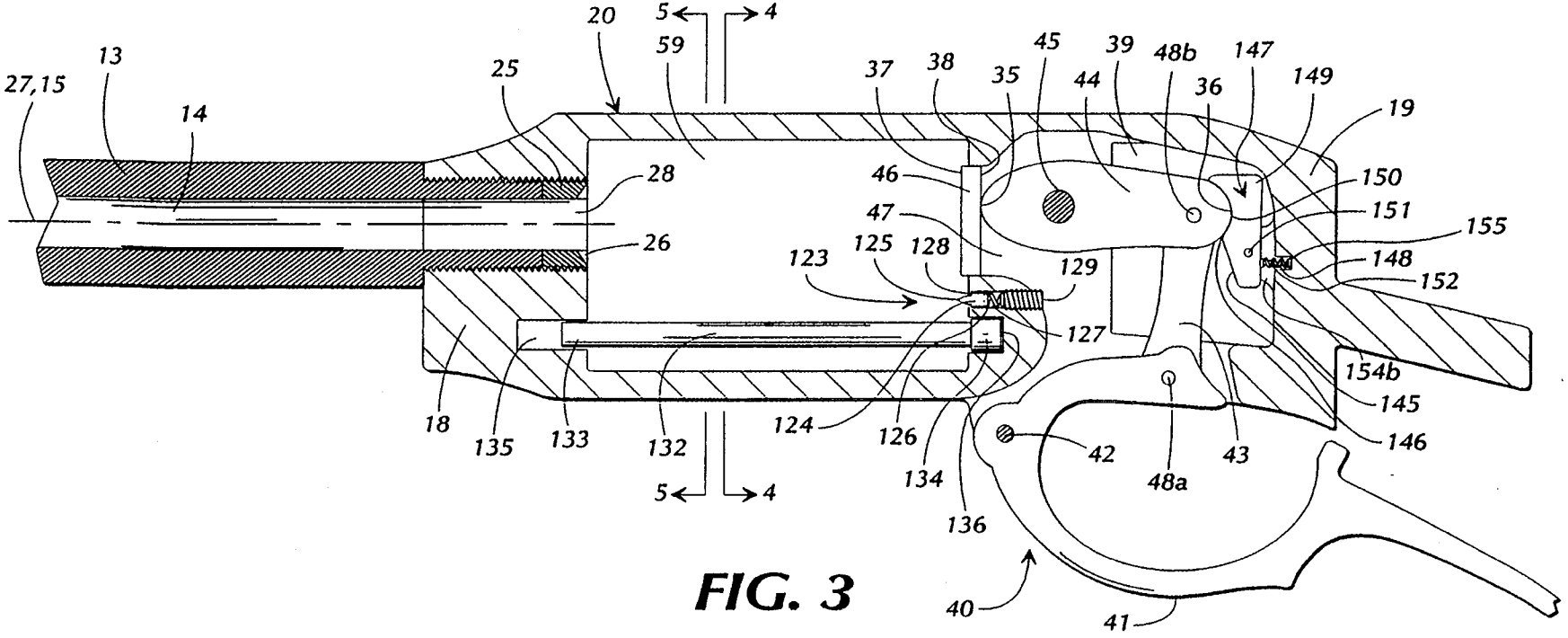
FIG. 3 is a cross-sectional side view of portions of selected elements of FIG. 2.

FIGS. 2 and 3 show portions of the barrel extension 13, frame 20, oscillator mechanism 130, and cam mechanism 40 in greater detail. The trigger 21, hammer 22, forearm 16, and shoulder stock 17 are omitted from FIGS. 2 and 3, and later figures, for simplicity since these elements function in a manner that is normal to conventional muzzle loading rifles and are considered understood by those reasonably skilled in the industry. The frame rear 19, the majority of the cam mechanism 40, and a cam cavity 39, which is defined by the frame 20, are exposed in FIGS. 2 and 3 since the shoulder stock 17 is omitted.

A gas seal 25 is threadedly connected to the frame front 18 and defines a seal beveled surface 26. The gas seal 25 further defines a seal bore 28 and a seal centerline 27. The barrel extension 13 is threadedly connected to the frame front 18 and defines a extension bore 14 and a extension centerline 15 that is collinear with the seal centerline 27. The extension bore 14, of the preferred embodiment of the present invention, is sized and rifled like modern breech loaded rifles as would be understood by those reasonably skilled in the industry. This is in contrast to the required norm of conventional muzzle loaded rifles.

The barrel bore diameter of conventional muzzle loading rifles is large relative to the lead balls shot by them because the lead balls must be loaded into and manually forced down the length of the barrel bore. Conversely, the barrel bore diameter of modern breech loaded rifles is small relative to the projectiles shot by them; thus optimizing contact between the projectile and rifling. The barrel bore diameter of modern breech loaded rifles can be small relative to the projectiles shot by them because the projectiles do not enter the barrel bore until the rifle is fired. As will be explained later, a lead ball 110 shot by the Quick Muzzle Loading Rifle 10 does not enter the extension bore 14 until the Quick Muzzle Loading Rifle 10 is fired. Thus, unlike conventional muzzle loaded rifles, the extension bore 14 diameter of the present invention is preferably small relative to the lead balls 110 shot by the Quick Muzzle Loading Rifle 10.

The rifling of conventional muzzle loading rifles consists of relatively tall, wide lands and deep, wide groves that make a complete turn in a relatively long distance. Such rifling is necessary to compensate for the relatively poor contact between the projectile and rifling that results from the relatively large barrel bore diameter. Due to the relatively small diameter of the extension bore 14, relative to the diameter of the lead balls 110 intended to pass through the extension bore 14, there is relatively good contact between the lead balls 110 and rifling of the preferred embodiment of the Quick Muzzle Loading Rifle 10. Therefore, the extension bore 14 is rifled like modern breech loaded rifles as would be understood by those reasonably skilled in the industry. As compared to the barrels of conventional muzzle loading rifles, the extension bore 14 is rifled with relatively short, narrow lands and wide, shallow groves that make a complete turn in a relatively short distance. By way of example only, one acceptable set of specifications for the preferred embodiment includes rifling that makes a complete turn in 44 inches and consists of six lands 0.007 in. high and 0.0625 in. wide, and six grooves 0.007 in. deep and 0.1875 in. wide; a bore diameter of 0.470 in., measured from the base of one groove to the base of another groove,; and lead balls (110) 0.470 in. in diameter. In order to facilitate this preferred rifling, the barrel extension 13 of the preferred embodiment is manufactured from one of the hardest steals, for example carbon manganese steel, so that the lands will not erode.

Examining the cam mechanism 40 in greater detail, a cam lever 41, a portion of which is omitted for simplicity, is rotatably attached to the frame middle 23 by a cam lever bolt 42 (See FIGS. 2 and 3). The cam lever 41 is movably connected by a connector pin 48*a* to a cam connector 43. The cam connector 43 is also moveably connected by a connector pin 48*b* to a cam 44. The cam 44 is rotatably attached to the frame middle 23 by a cam bolt 45. The cam 44 includes a cam lobe 35 and a cam rear 36. A cam button 46 is moveably contained in a button cavity 47 which is defined by the frame middle 23 and interposed between and communicating with the short barrel cavity 59 and the cam cavity 39. The cam button 46 further includes a button front 37 and a button rear 38. The cam mechanism further 40 includes a cam lock 147 which includes a lock wedge 149 pivotally connected through a wedge pin 151 to ride in two flange slots 153*a,b* (flange slot 153*b* being concealed) defined by two lock flanges 154*a,b* of the frame rear 19. A spring pin 152 protrudes from the lock wedge 149. A cam lock spring 148 encircles the spring pin 152 and extends into a spring recess 155 defined by the frame rear 19. The lock wedge 149 further includes an engaging surface 145, a peak 146 and a locking surface 150 contacting the cam 44.

The oscillator mechanism 130 (see FIGS. 2 and 3) includes an oscillator 131 (for lack of a better term we have chosen to call this the oscillator) moveably connected to the frame front 18 and frame rear 19 by an oscillator pin 132 which passes through the oscillator 131. The oscillator 131 has an oscillator rear 141 that faces toward the frame rear 19 and an oscillator side 142 that is seen in FIG. 2. The oscillator pin 132 has a pin front 133 and a pin rear 134 that are confined within a front pin cavity 135 defined by the frame front 18 and a rear pin cavity 136 defined by the frame middle 23, respectively. An oscillator release spring 137, which is wrapped around the oscillator pin 132, biases the oscillator 131 and short barrel 50 toward the frame rear 19. An oscillator swing out spring 138, which is also wrapped around the oscillator pin 132, biases the oscillator 131 and short barrel 50 toward a pivoted position to the side of the frame 20.

Figure 6:
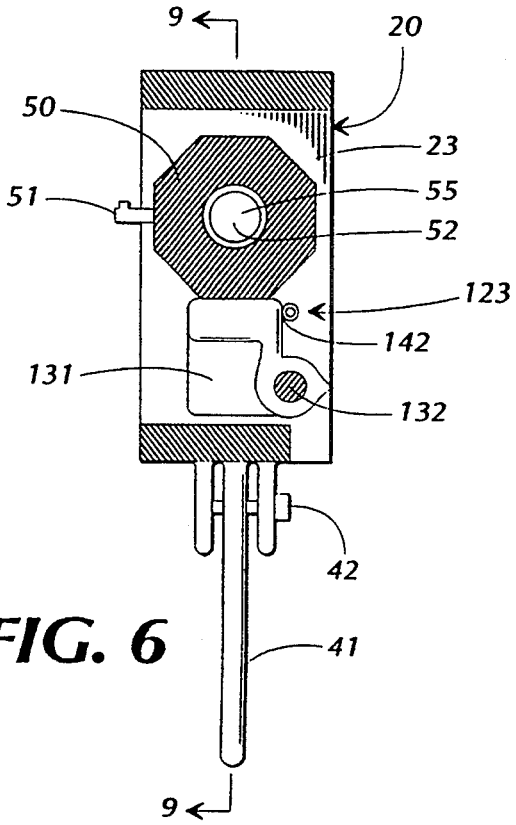
FIG. 6 is a cross-sectional front view taken along line 6—6 of FIG. 2.
Figure 7:
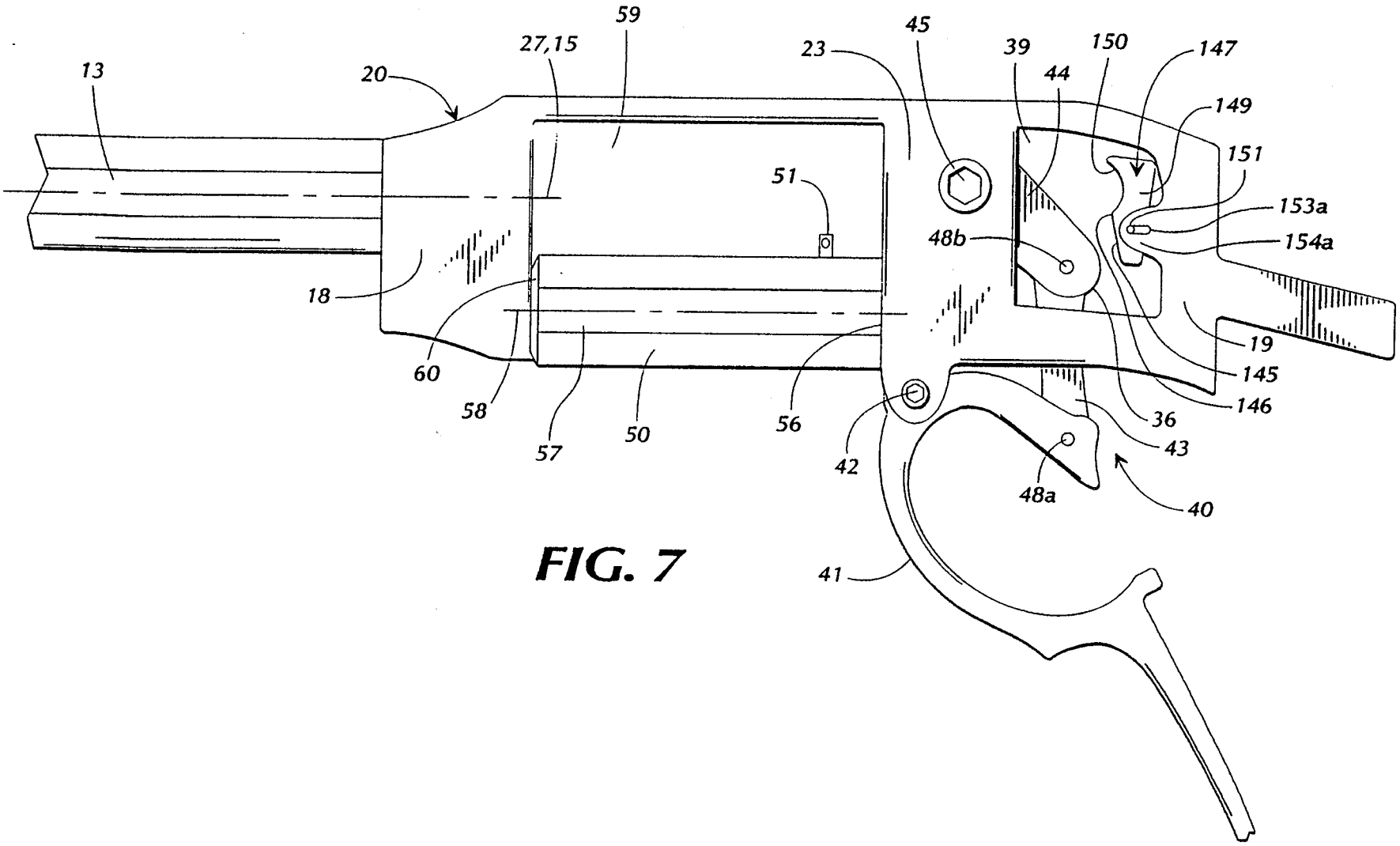
FIG. 7 is a side view of portions of the Quick Muzzle Loading Rifle in accordance with the preferred embodiment of the present invention, shown in a disengaged condition.
Figure 9:
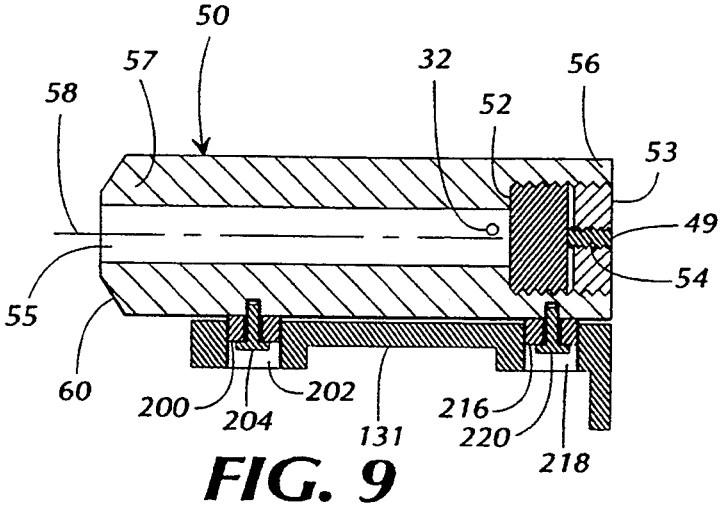
FIG. 9 is a cut-away, cross-sectional view of selected elements of FIG. 6, taken along line 9—9 of FIG. 6.

The short barrel 50 is connected to the oscillator 131 (See FIGS. 2 and 6). The short barrel 50 has a short barrel breech 56 and a short barrel muzzle 57. The short barrel 50 defines a short barrel bore 55, which is concealed in FIG. 2, and a short barrel centerline 58. In FIG. 2, the short barrel centerline 58 is collinear with the extension centerline 15. With reference to FIGS. 7 and 9, the short barrel 50 is seen formed with a muzzle bevel 60 at the short barrel muzzle 50. With reference to FIG. 3, a short barrel lock 123 is shown protruding into the short barrel cavity 59 from a lock recess 127. The lock recess 127 is defined by the frame middle 23 and the lock recess 127 is interposed between the short barrel cavity 59 and the cam cavity 39. A lock plug 129 is threadedly connected to the frame middle 23 and blocks the lock recess 127 from the cam cavity 39. The short barrel lock 123 is shown including a lock spring 126 and a lock pin 124 which further includes a rounded pin tip 125. The lock spring 126 biases the pin tip 125 toward the frame front. The frame middle 23 defines a lock lip 128 that maintains the lock pin 123 within the lock recess 127 and allows the pin tip 125 to protrude into the short barrel cavity.

Figure 4:
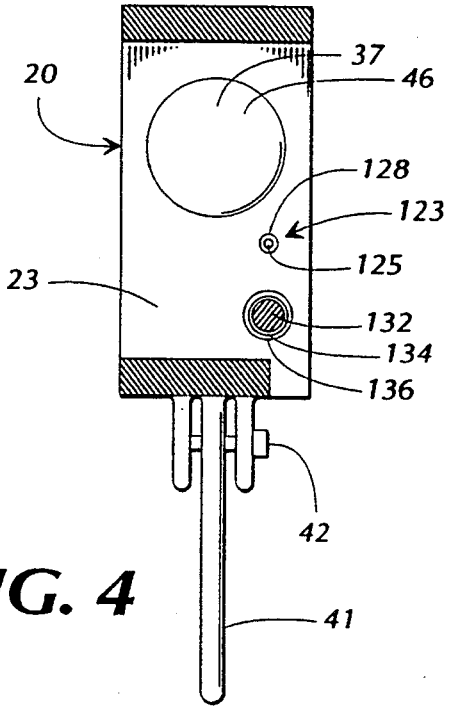
FIG. 4 is a cross-sectional front view taken along line 4—4 of FIG. 3.
Figure 5:
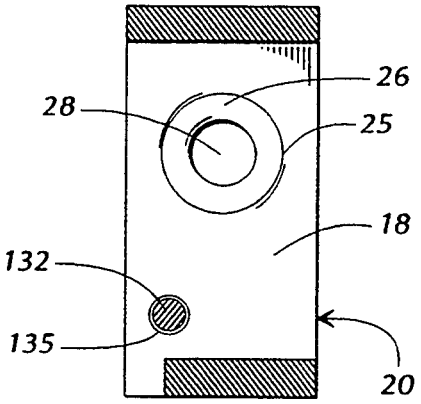
FIG. 5 is a cross-sectional rear view taken along line 5—5 of FIG. 3.

FIG. 4 is a cross-sectional front view taken along line 4—4 of FIG. 3. The relative position of the short barrel lock 123, oscillator pin 132, and cam button 46 are shown. FIG. 5 is a cross-sectional rear view taken along line 5—5 of FIG. 3. The relative position of the gas seal 25 and oscillator pin 132 are shown. FIG. 6 is a cross-sectional front view taken along line 6—6 of FIG. 2. The oscillator pin 132 is shown passing through the oscillator 131.

Figure 8:
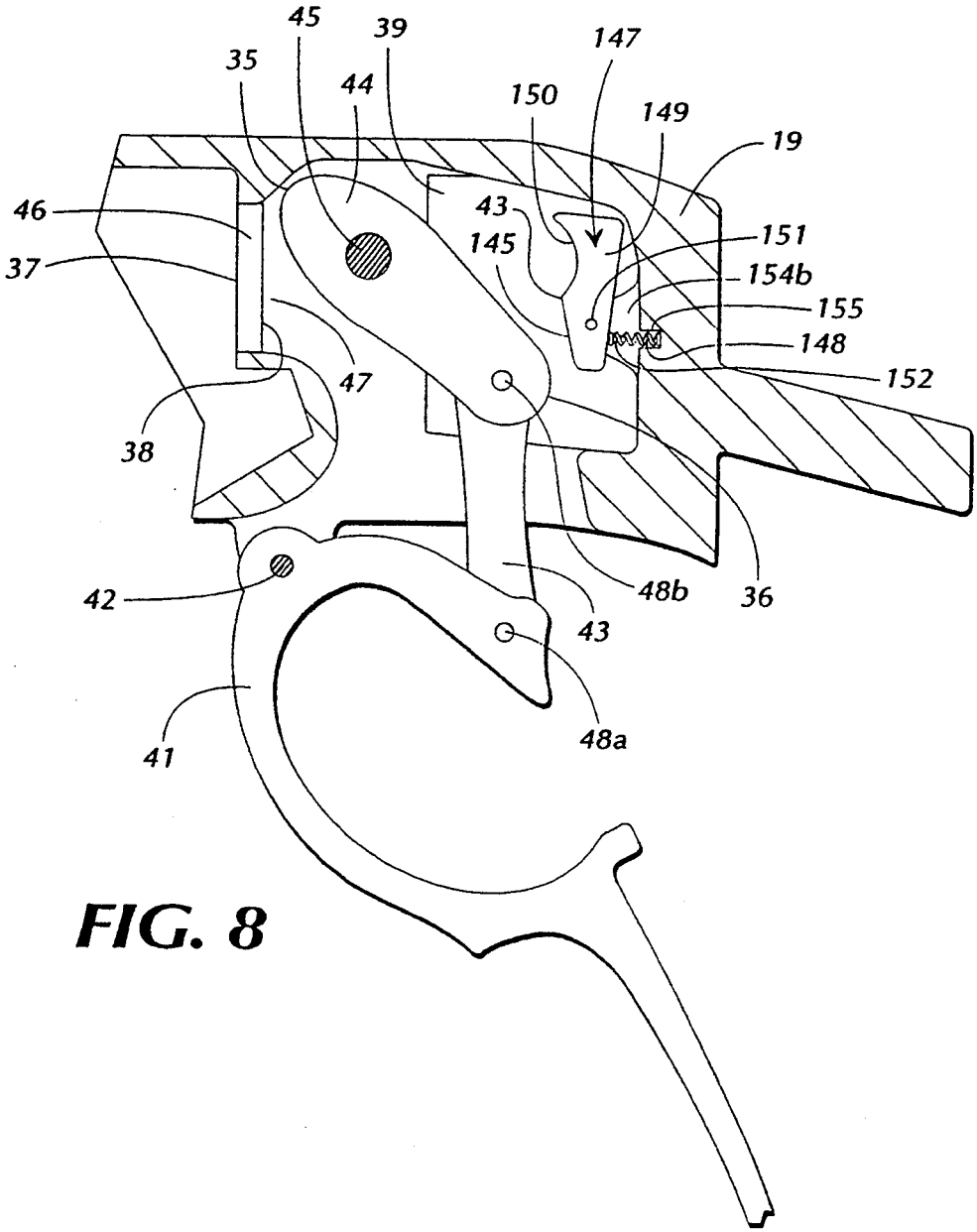
FIG. 8 is a cross-sectional side view of portions of selected elements of FIG. 7.

FIG. 7 is a side view of portions of the Quick Muzzle Loading Rifle 10 in accordance with the preferred embodiment of the present invention, shown in a disengaged condition. As shown, the cam 44 is not contacting the cam lock 147, and the short barrel centerline 58 is not in-line with the extension centerline 15. Also, the muzzle bevel 60 is seen at the short barrel muzzle 57. FIG. 8 is a cross-sectional side view of portions of selected elements of FIG. 7. As shown, the cam 44 is not contacting the cam button 46 or the cam lock 147.

FIG. 9 is a cut-away, cross-sectional view of the short barrel 50 and oscillator 131, taken along line 9—9 of FIG. 6. FIG. 9 shows a short barrel muzzle 57 and a short barrel breech 56. A solid breech plug 52 is also shown threadedly connected to short barrel 50 and completely sealing the short barrel bore 55. A gas seal adjuster 53 is threadedly connected to the short barrel breech 56. The gas seal adjuster 53 defines an adjuster bore 54. A set screw 49 is threadedly connected to the gas seal adjuster 53 through the adjuster bore 54. The short barrel bore 55 is tapered so that its diameter is larger at the short barrel muzzle 57 than it is at the breech plug 52. A spark port 32 is formed through the short barrel 50, from the short barrel bore 55 to the outer surface of the short barrel 50. With reference to FIG. 6, a percussion mechanism 51, the nature and operation of which would be understood by those reasonably skilled in the industry, is threadedly or otherwise attached to the short barrel 50 and is in communication with the spark port 32. In alternate embodiments of the present invention a flintlock mechanism, the nature and operation of which would be understood by those reasonably skilled in the industry, is threadedly or otherwise attached to the short barrel 50 and is in communication with the spark port 32.

Figure 10:
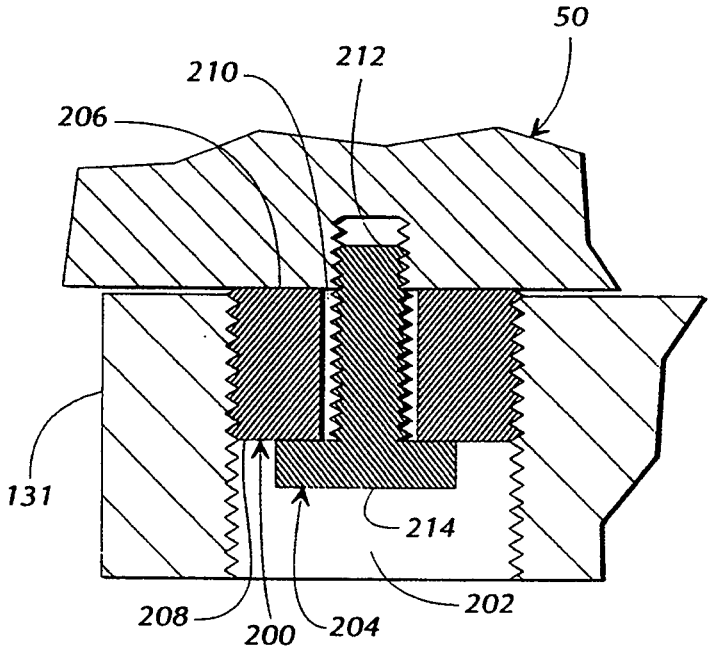
FIG. 10 is an enlarged, cut-away view of selected portions of FIG. 9

Referring further to FIG. 9, the short barrel 50 is attached to the oscillator 131 toward the short barrel muzzle 57, in part, by a first adjustment sleeve 200 that is cylindrical and threadedly engaged to the oscillator 131 within a first attachment port 202 that is cylindrical and defined within the oscillator 131. A first attachment bolt 204 passes through the first adjustment sleeve 200 and threadedly engages the short barrel 50. FIG. 10 is an enlarged, cut-away view of FIG. 9 showing the engagement and interaction between the first adjustment sleeve 200, oscillator 131, first attachment port 202, first attachment bolt 204, and short barrel 50. FIG. 10 shows the threaded engagement between the first adjustment sleeve 200 and the oscillator 131 within the first attachment port 202; the threaded engagement allows for adjustment to the positioning of the adjustment sleeve 200 within the first attachment port 202. The adjustment sleeve 200 includes a first end 206, which is engaging the short barrel 50 in FIG. 10, and a second end 208, and defines a cylindrical port 210 therethrough. The first attachment bolt 204 includes a shaft 212 that passes freely through the cylindrical port 210 of the first adjustment sleeve 200 and is threadedly engaged to the short barrel 50, and a head 214 that engages the second end 208 of the first adjustment sleeve 200. By selectively adjusting the positioning of the first adjustment sleeve 200, and securely threading the first attachment bolt 204 therethrough to the short barrel 50, the position of the short barrel 50 relative to the oscillator 131 is selectively adjusted.

Referring back to FIG. 9, the short barrel 50 is also attached to the oscillator 131 toward the short barrel breech 56. This attachment is facilitated, in part, by a second adjustment sleeve 216 that is cylindrical and threadedly engaged to the oscillator 131 within a second attachment port 218 that is cylindrical and defined within the oscillator 131. A second attachment bolt 220 passes freely through the second adjustment sleeve 216 and threadedly engages the short barrel 50. An enlarged, cut-away view showing the engagement and interaction between the second adjustment sleeve 216, oscillator 131, second attachment port 218, second attachment bolt 220, and short barrel 50 would be substantially similar to FIG. 10. By selectively adjusting the positioning of the second adjustment sleeve 216, and securely threading the second attachment bolt 220 therethrough to the short barrel 50, the positioning of the short barrel 50 relative to the oscillator 131 is selectively adjusted.

Figure 11:
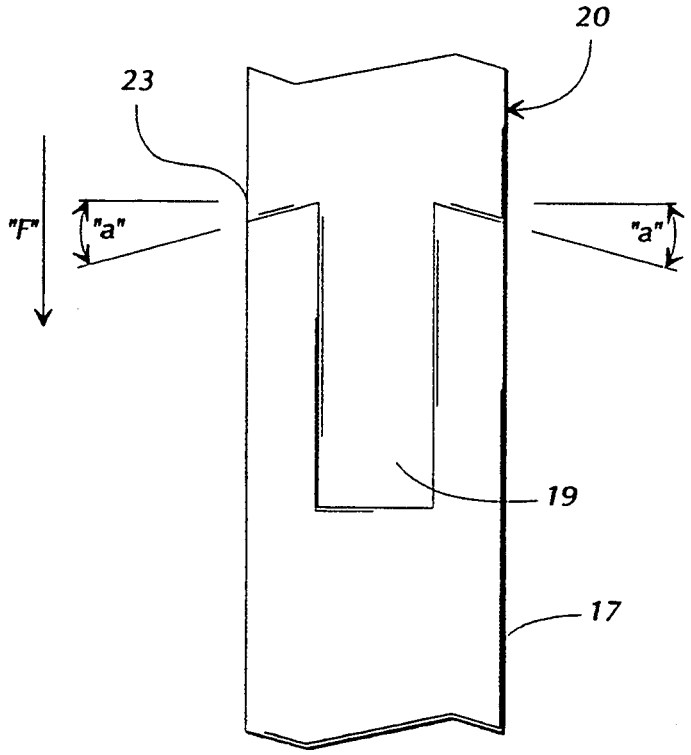
FIG. 11 is a top, cut-away view of selected portions of the Quick Muzzle Loading Rifle of FIG. 1.

FIG. 11 is a top, cut-away view of the Quick Muzzle Loading Rifle of FIG. 1 showing the engagement between the frame 20 and the shoulder stock 17. As shown, the frame rear 19 extends into and engages the shoulder stock 17, and portions of the frame middle 23 engage the should stock 17. The portions of the shoulder stock 17 and frame middle 23 that are in engagement define angles "a". By virtue of the angles "a", when the Quick Muzzle Loading Rifle 10 is fired, as discussed below, and recoil causes the frame 20 to exert force (represented by the vector "F" on FIG. 11) on the shoulder stock 17, the frame middle 23 tends to "pinch the shoulder stock 17 together". This seeks to preclude the splitting of the shoulder stock 17.

The Quick Muzzle Loading Rifle 10 is preferably constructed of several different materials. For the purpose of example only, the barrel extension 13, short barrel 50, breech plug 52 and gas seal adjuster 53 are preferably made from carbon manganese steel; the cam button 46, cam 44, and cam lock 147 are preferably made from case hardened steel; the forearm 16 and shoulder stock 17 are preferably made of walnut or some other suitable wood; the oscillator release spring 137 and oscillator swing out spring 138 are preferably made of steel; and the other components are preferably made from silicon bronze.

Operation of the Quick Muzzle Loading Rifle

In order to use the Quick Muzzle Loading Rifle 10, it must first be loaded. Assuming that the loading process is begun with the Quick Muzzle Loading Rifle 10 in the disengaged condition shown in FIG. 7, (i.e., with the short barrel 50 is a loading position), the rifle 10 is loaded by depositing an appropriate amount of black powder 111 and a lead ball 110 into the short barrel bore 55. The lead ball 110 is forced into the short barrel bore 55 so that the lead ball 110 is wedged into and held in place by the tapered short barrel bore 55 and the black powder 111 is encased between the lead ball 110 and the breech plug 52. Then the short barrel 50 is manually pivoted about the oscillator pin 132 and placed within the short barrel cavity 59, aligning the extension centerline 15 and short barrel centerline 58, (i.e., the short barrel 50 is placed in a ready position). While the short barrel 50 is in the loading position, and positions between the loading position and the ready position, the pin tip 125 is in contact with the oscillator rear 141. While the pin tip 125 is in contact with the oscillator rear 141, the frictional forces between the pin tip 125 and the oscillator rear 141 are not large enough to interfere with movement of the oscillator 131. However, when the short barrel 50 is in the ready position the pin tip 125 is not in contact with the oscillator rear 141 (see FIG. 6). When the short barrel 50 is in the ready position, the oscillator release spring 137 forces the oscillator 131 to a position sufficiently toward the frame rear 19 so that the side of the pin tip 125 is in contact with the oscillator side 142. Therefore, the pin tip 125 keeps the oscillator swing out spring 138 from swinging the oscillator 131 to the side of the frame 20 and maintains the short barrel 50 in the ready position.

In accordance with an alternate preferred embodiment of the present invention, the Quick Muzzle Loading Rifle 10 does not include the short barrel lock 123 and the elements associated directly therewith. Therefore a pin tip 125 is not available to maintain the short barrel 50 in the ready position. In accordance with the alternate preferred embodiment, the short barrel 50 is manually maintained in the ready position, as should be understood by those reasonably skilled in the art upon understanding this disclosure.

In accordance with the preferred embodiment of the present invention, once the short barrel 50 is in the ready position, the Quick Muzzle Loading Rifle 10 is put into an engaged condition as shown in FIGS. 1, 2, and 3 by manually positioning the cam lever 41 close to the shoulder stock 17 and the frame rear 19. As the cam lever 41 is pushed toward the shoulder stock 17, the cam connector 43 is set into motion by the cam lever 41 and the cam 44 is set into motion by the cam connector 43. As the cam 44 pivots about the cam bolt 45, the cam lobe 35 slidingly contacts and applies force to the button rear 38, and the cam rear 36 slidingly contacts the engaging surface 145. The contact between the cam rear 16 and the engaging surface 145 causes the lock wedge 149 to move toward the frame rear 19. As the cam 44 continues to pivot, the cam rear 36 slides across the peak 146 and comes into contact with the locking surface 150. Once the cam rear 36 is in full contact with the locking surface 150 the cam lock spring 148 applies sufficient force to the lock wedge 149 to lock the Quick Muzzle Loading Rifle 10 in the engaged position, absent a manual force applied to move the cam lever 41 away from the shoulder stock 17.

The contact between the cam lobe 35 and the button rear 38 causes the cam button 46 to move in the button cavity 47 toward the short barrel cavity 59 so that the button front 37 contacts and applies force to the short barrel breech 56. This causes the short barrel muzzle 57 to thrust toward the frame front 18, resulting in the muzzle bevel 60 being securely forced against the seal beveled surface 26 to form a tight seal between the muzzle bevel 60 and the seal beveled surface 26. Once the Quick Muzzle Loading Rifle 10 is loaded and in the engaged condition, it is ready to fire in a manner that is common to loaded conventional muzzle loading rifles, wherein a spark is caused to enter the short barrel bore 55 through the spark port 32.

When the Quick Muzzle Loading Rifle 10 is fired there is essentially no leakage of gas from between the short barrel 50 and barrel extension 13 since the muzzle bevel 60 is forced securely against the seal beveled surface 26. Also, the lead ball 110 fired by the Quick Muzzle Loading Rifle 10, when sized in accordance with the preferred embodiment of the present invention, occupies to a large extent the extension bore 14, thus minimizing gas leakage around the lead ball 110.

Referring to FIG. 9, if the seal between the muzzle bevel 60 and the seal beveled surface 26 is not tight enough, it is tightened by adjusting the gas seal adjuster 53 which adjusts the effective length of the short barrel 50 so that the muzzle bevel 60 is forced securely against the seal beveled surface 26 when the Quick Muzzle Loading Rifle 10 is in the engaged condition. The adjustment is made after rotating the set screw 49 to unlock the gas seal adjuster 53. The gas seal adjuster 53 is then rotated to, for example, move it out of the short barrel 50; thus effectively lengthening the short barrel 50. When the combined, net length of the gas seal adjuster 53 and the short barrel 50 is the appropriate length, the set screw 49 is rotated to lock the gas seal adjuster 53 in the correct position.

Referring to FIGS. 9 and 10, if the seal between the muzzle bevel 60 and the seal beveled surface 26 is not tight enough, the engagement therebetween can also be affected by adjusting the alignment between the extension centerline 15 (FIG. 2), seal centerline 27 (FIG. 2), and the short barrel centerline 58. This adjustment is affected by selectively coordinating the adjustment of the first adjustment sleeve 200 and second adjustment sleeve 216. Adjustment of the sleeves 200,216 is discussed above.

After the Quick Muzzle Loading Rifle 10 has been fired, it can be reloaded and fired again. In order to reload it, the Quick Muzzle Loading Rifle 10 must be put into the disengaged condition as shown in FIGS. 7 and 8 by manually forcing the Cam lever 41 away from the shoulder stock 17 and the frame rear 19. As the cam lever 41 is pushed away from the shoulder stock 17, the cam connector 43 is set into motion by the cam lever 41, and the cam 44 is set into motion by the cam connector 43. As the cam 44 pivots about the cam bolt 45, the cam lobe 35 begins sliding across and applying less force to the button rear 38, and the cam rear 36 begins sliding across the locking surface 150, moving the lock wedge 149 toward the frame rear 19. As the cam 44 continues to pivot, the cam rear 36 slides across the peak 146 and along the engaging surface 145 until the cam rear no longer contacts the lock wedge 149. The cam lobe 35 slides across the button rear 38 until the cam lobe 35 no longer contacts and applies no force to the button rear 38. When the cam lobe 35 ceases to apply force to the button rear 38, the button front 37 ceases to apply force to the short barrel breech 56, and the oscillator release spring 137 forces the short barrel 50 to move toward the frame middle 23. The short barrel breech 56 applies force on the button front 37 and causes the cam button 46 to move toward the frame rear 19 until the cam button 46 no longer protrudes into the short barrel cavity 59. Once the short barrel 50 moves sufficiently toward the frame middle 23, the short barrel 50 and oscillator 131 are forced to pivot about the oscillator pin 132 and out to the side of the frame 20 by the oscillator swing out spring 138. The short barrel lock 123 does not interfere with these movements because when the Quick Muzzle Loading Rifle 10 is in the engaged condition, the oscillator 131 is in a position sufficiently toward the frame front 18 so that the pin tip 125 does not contact the oscillator 131. Also, as soon as the oscillator release spring 137 forces the short barrel 50 to move toward the frame middle 23, the oscillator swing out spring 138 forces the short barrel to swing toward the side of the frame 20. Therefore, by the time the oscillator 131 contacts the pin tip 125, the oscillator 131 has pivoted sufficiently so that the oscillator rear 141 contacts the pin tip 125 and, as specified above, the frictional forces between the pin tip 125 and the oscillator rear 141 are not large enough to interfere with movement of the oscillator 131.

The Quick Loader

Figure 12:
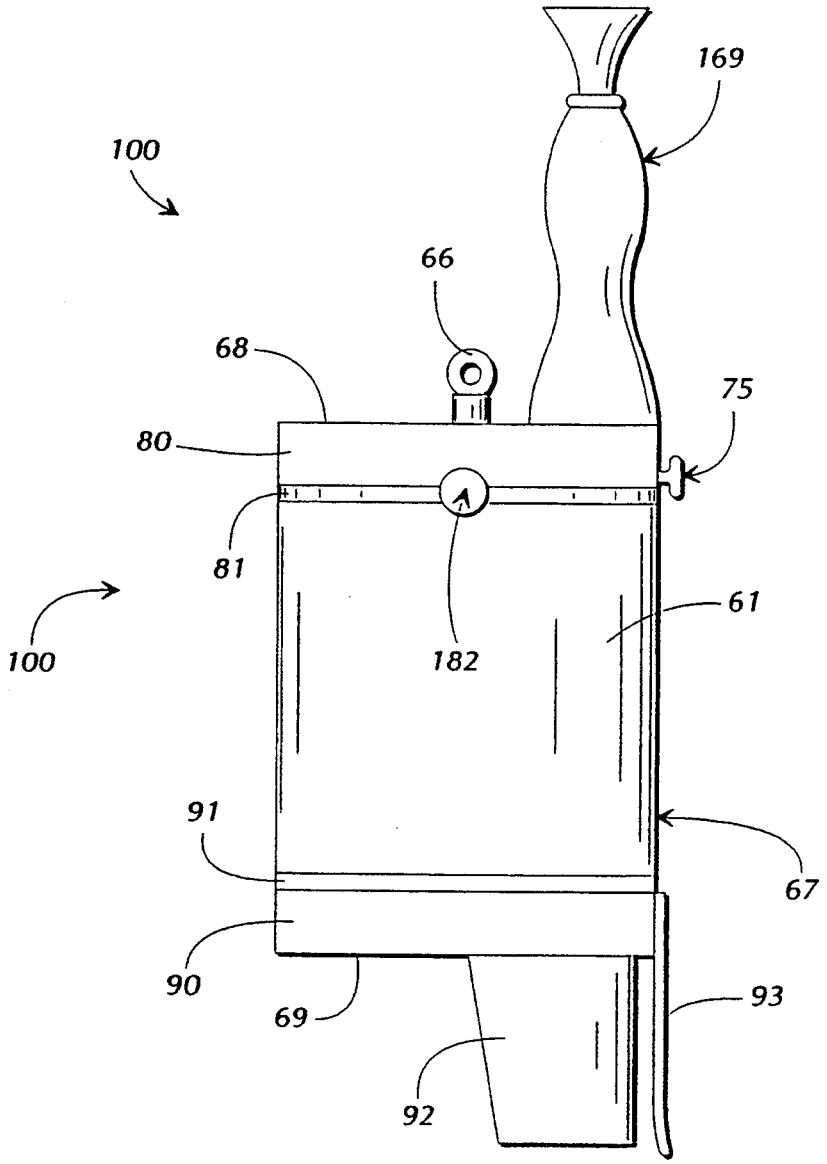
FIG. 12 is a side view of a Quick Loader in accordance with the preferred embodiment of the present invention, shown in an un-cocked condition.

FIG. 12 is a side view of a Quick Loader 100, in accordance with the preferred embodiment of the present invention. The Quick Loader 100 includes a cylinder assembly 67 connected to a ramrod assembly 169 and an arbor jam nut 66 on a cylinder assembly top end 68, and a short barrel support 92 and a short barrel holder 93 on a cylinder assembly bottom end 69. The cylinder assembly 67 is shown including a main cylinder 61 which extends between a top disk 81 and a base disk 91, which are connected to a cylinder top plate 80 and a cylinder base plate 90, respectively. An indexer lock 182 and a ramrod lock 75 are shown extending outward from the top disk 81 and the cylinder top plate 80, respectively.

Figure 13:
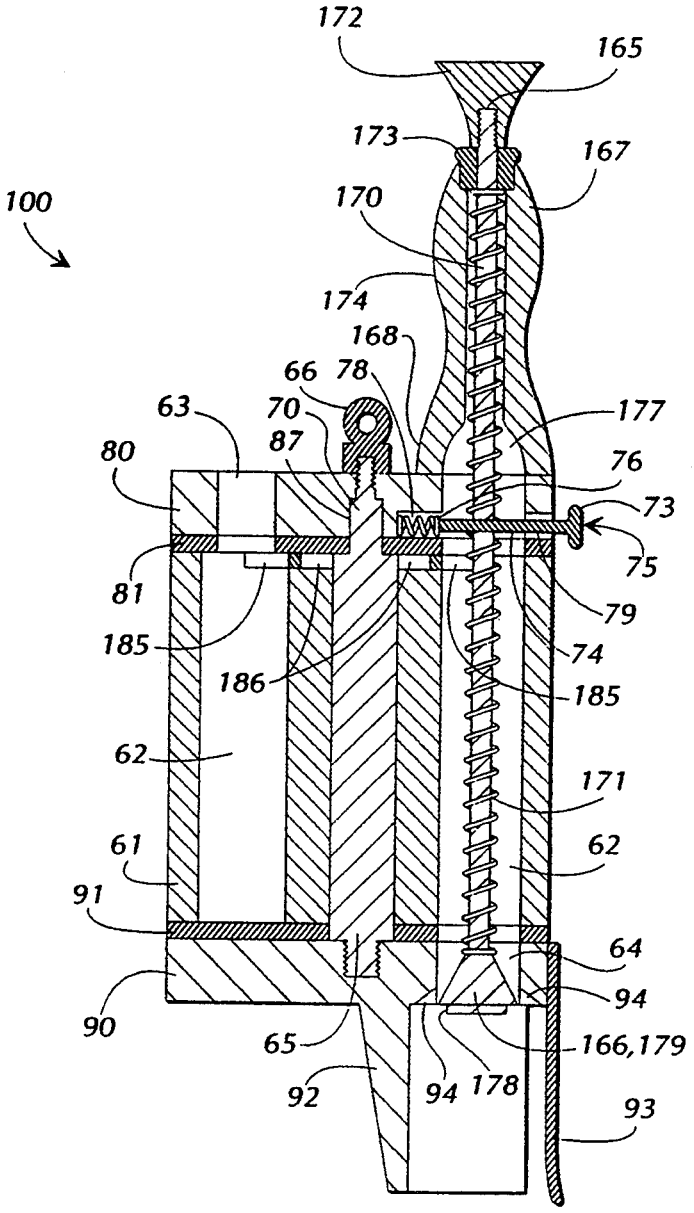
FIG. 13 is a side cross-sectional view of the Quick Loader of FIG. 12.
Figure 14:
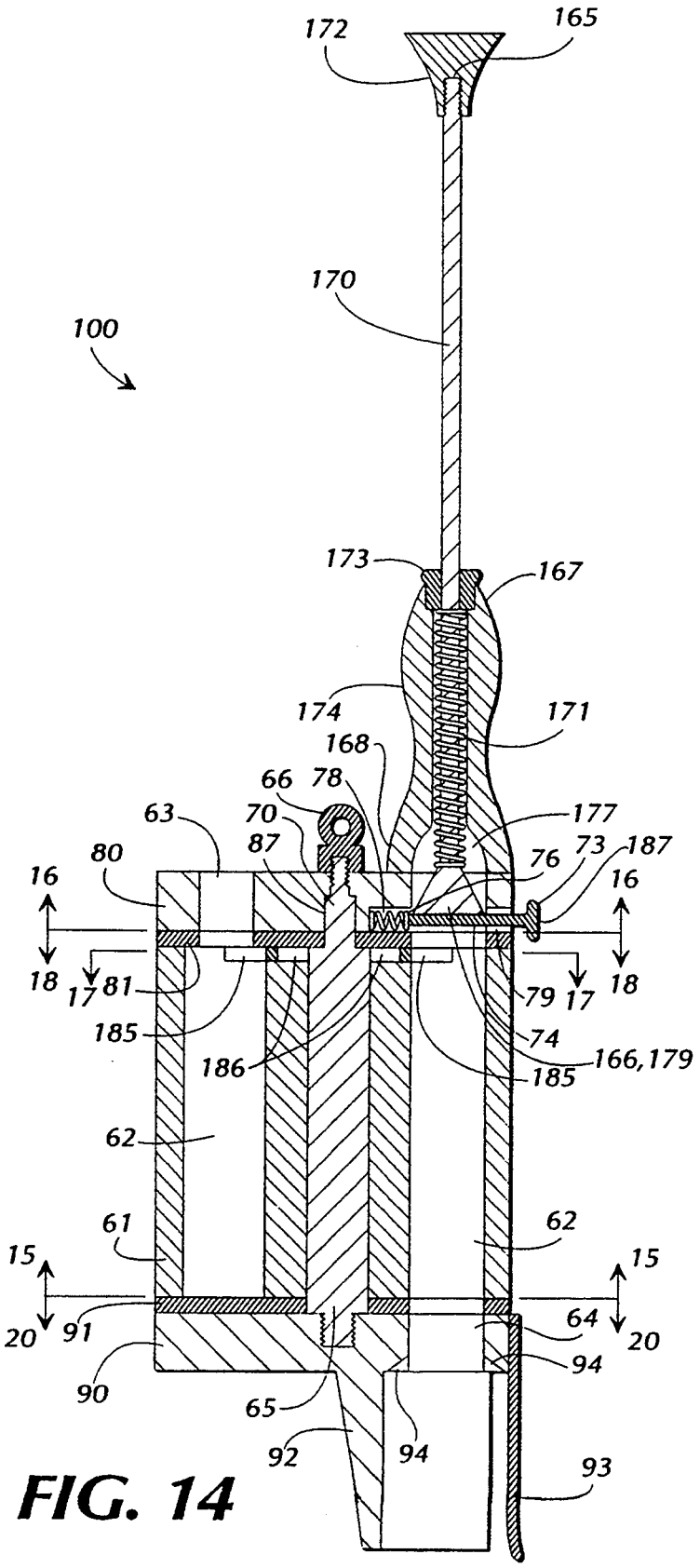
FIG. 14 is a side cross-sectional view of the Quick Loader of FIG. 12 shown in the cocked condition.

FIGS. 13 and 14 are side cross-sectional views of the Quick Loader 100 of FIG. 12, showing un-cocked and cocked conditions, respectively. Screws (unseen) secure the top disk 81 to the cylinder top plate 80 and the base disk 91 to the cylinder base plate 90. The cylinder top plate 80 and cylinder base plate 90 are rigidly connected to each other by a cylinder arbor 65 which is threadedly connected to the cylinder base plate 90 and the arbor jam nut 66. The cylinder arbor 65 includes a cylinder arbor block 70 which extends into a block notch 87 defined by the cylinder top plate 80. The cylinder arbor 65 passes through the center of the main cylinder 61 such that the main cylinder 61 may rotate relative to the cylinder top plate 80 and the cylinder base plate 90.

Two storage cavities 62 of a plurality of storage cavities 62 that are defined by the main cylinder 61 are shown. Each storage cavity 62 of the plurality of storage cavities 62 has a diameter slightly larger than the lead balls 110 stored in the Quick Loader 100. Also shown is a discharge cavity 64 which is defined by the cylinder base plate 90 and base disk 91. The discharge cavity 64 is the same diameter as the storage cavities 62 and is always oriented in-line with the ramrod assembly 169. The cylinder base plate defines a base bevel surface 94 that encircles the discharge cavity 64. Also shown is one sight cavity 63 of a plurality of sight cavities 63 that are defined by the cylinder top plate 80 and top disk 81. Each sight cavity 63 of the plurality of sight cavities 63 has a diameter smaller than the lead balls 110.

The ramrod assembly 169 includes a ramrod support structure 174 that has a structure top 167 and a structure bottom 168. The structure bottom 168 is attached to the cylinder top plate 80 by conventional means. A ramrod bushing 173 is connected to the structure top 167 by conventional means. A ramrod cavity 177 is defined within the ramrod support structure 174, ramrod bushing 173, cylinder top plate 80, and top disk 81. A ramrod 170 is movably contained by the ramrod cavity 177. The ramrod 170 has a ramrod top 165 that extends out of the structure top 176 and is threadedly connected to a pull button 172. The ramrod bottom 166 is flared and forms a ramrod foot 179. A foot lip 178 is defined at the perimeter of the ramrod foot 179. A ramrod spring 171 encircles the ramrod 170 and is confined between the ramrod bushing 173 and the ramrod foot 179. Due to the rotatability of the main cylinder 61 and the orientation of those cavities identified Just above, the ramrod cavity 177 and the discharge cavity 64 are always aligned with each other and are capable of being aligned with each storage cavity 62 of the plurality of storage cavities 62. Likewise, each storage cavity 62 of the plurality of storage cavities 62 is capable of being aligned with each sight cavity 63 of the plurality of sight cavities 63.

Figure 15:
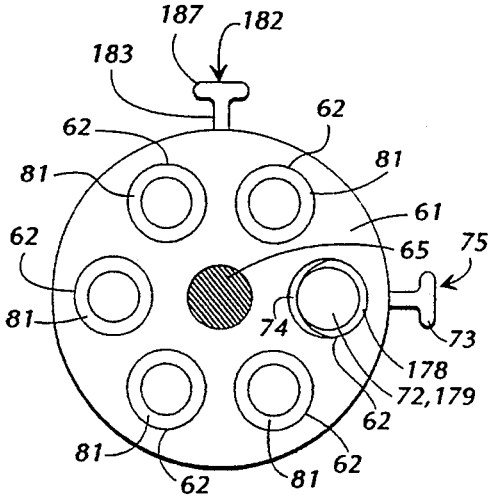
FIG. 15 is a bottom cross-sectional view of the Quick Loader of FIG. 14, taken along line 15—15 of FIG. 14.
Figure 16:
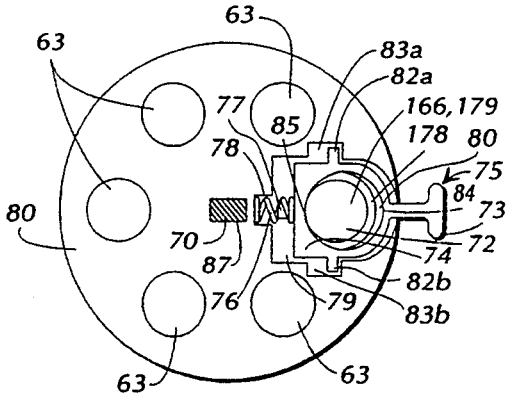
FIG. 16 is a bottom cross-sectional view of the Quick Loader of FIG. 14, taken along line 16—16 of FIG. 14.

FIG. 15 is a bottom cross-sectional view taken along line 15—15 of FIG. 14. FIG. 16 is a bottom cross-sectional view taken along line 16—16 of FIG. 14. As shown, the ramrod lock 75 includes a lock plate 74 that dissects the ramrod cavity 177 and is housed in a lock cavity 79 defined by the cylinder top plate 80 and the top disk 81. Two plate flanges **82*a,b* protrude from the lock plate 74 and travel in two flange cavities 83*a,b* that are defined by the cylinder top plate 80 and the top disk 81. A lock button 73 protrudes from the lock plate 74 and out to the side of the Quick Loader 100. A spring pin 77 protrudes from the lock plate 74 and a lock spring 76 encircles the spring pin 77 and extends into a spring recess 78 defined by the cylinder top plate 80 and top disk 81. The lock plate 74 defines an elongated lock hole 72. The lock hole 72 has a passing portion 84 toward the lock button 73. The passing portion 84 is large enough so that the ramrod foot 179 can pass through the passing portion 84. The lock hole also has a catching portion 85 toward the spring pin 77. The catching portion 85 is small so that the ramrod foot 179 cannot pass through the catching portion 85 because the foot lip 178 contacts the lock plate 74. The lock spring 76 biases the lock plate 74 toward a position in which the catching portion 85 is in-line with the ramrod 170**.

Figure 17:
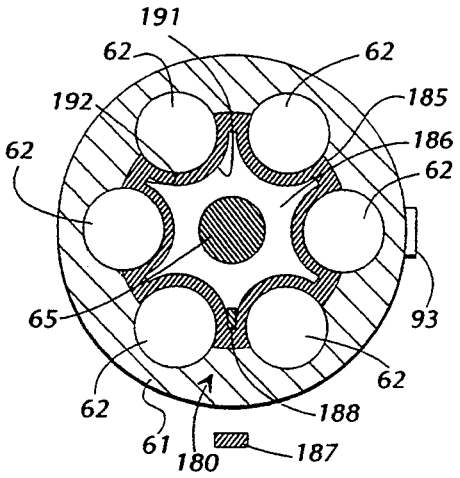
FIG. 17 is a top cross-sectional view of the Quick Loader of FIG. 14, taken along line 17—17 of FIG. 14.
Figure 18:
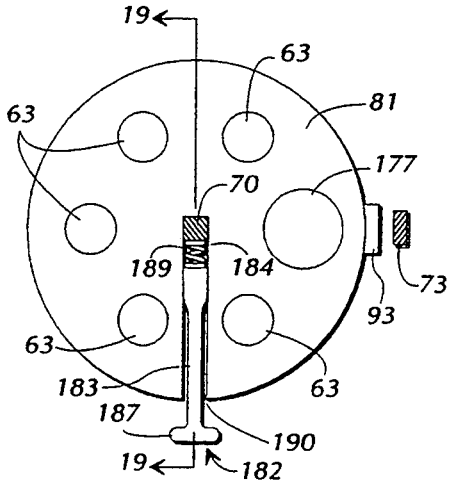
FIG. 18 is a top cross-sectional view of the Quick Loader of FIG. 14, taken along line 18—18 of FIG. 14.
Figure 19:
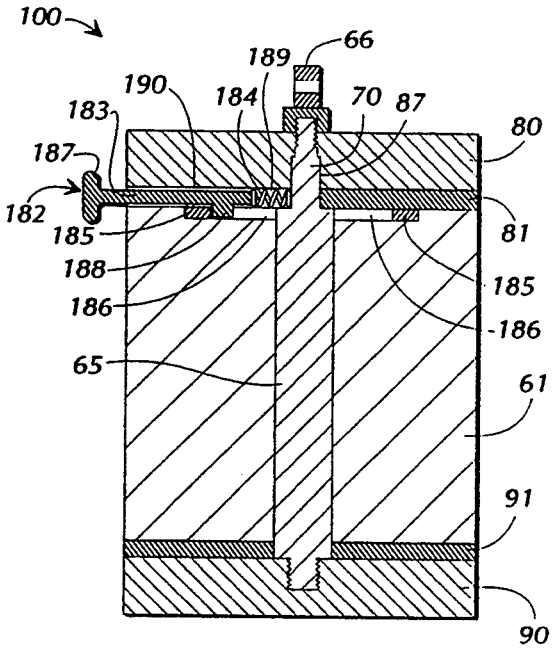
FIG. 19 is a side cross-sectional view of the Quick Loader of FIG. 14, taken along line 19—19 of FIG. 18.
Figure 20:
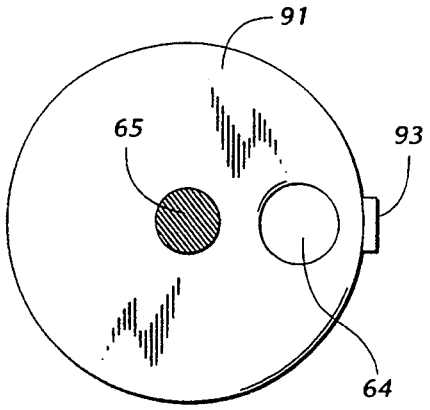
FIG. 20 is a top cross-sectional view of the Quick Loader of FIG. 14, taken along line 20—20 of FIG. 14.

FIG. 17 is a top cross-sectional view taken along line 17—17 of FIG. 14. FIG. 18 is a top cross-sectional view taken along line 18—18 of FIG. 14. FIG. 19 is a side cross-sectional view taken along line 19—19 of FIG. 18. Shown is an indexer mechanism 180 that includes an indexer lock 182 and an indexer plate 185. The indexer plate 185 fits securely into a portion of a plate cavity 186 that is defined by the main cylinder 61 and bordered by the top disk 81. As seen in FIG. 17, the indexer plate 185 defines a plurality of plate sliding surfaces 191 and a plurality of plate notches 192 (however, only one of the sliding surfaces 191 of the plurality of sliding surfaces 191 and only one of the notches 192 of the plurality of notches 192 are labeled in FIG. 17 for simplicity). As shown, the indexer lock 182 includes an indexer rod 183 that is housed in an indexer cavity 190 defined by top disk 81 and bordered by the cylinder top plate 80 and the main cylinder 61. An indexer button 187 protrudes from the indexer rod 183 and out to the side of the Quick Loader 100. An indexer spring 184 extends from a spring recess 189 defined by the top disk 81 to contact the indexer rod 183. An indexer flange 188 protrudes from the indexer rod 183 into the plate cavity 186. FIG. 20 is a top cross-sectional view taken along line 20—20 of FIG. 14. In the center of the figure is the cylinder arbor 65 which has been cross-sectioned. Also shown is the discharge cavity 64 and the short barrel holder 93.

Figure 21:
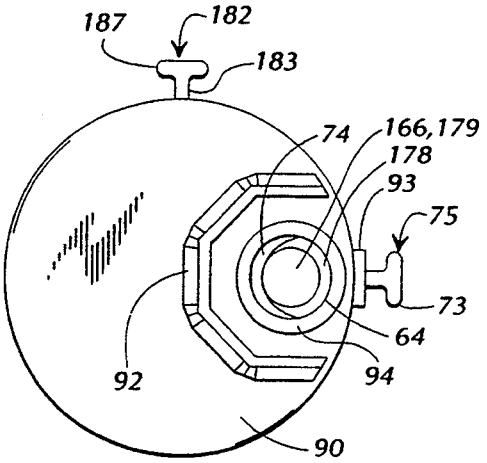
FIG. 21 is bottom view of the Quick Loader of FIG. 14.

FIG. 21 is a bottom view of the Quick Loader 100 of FIG. 14. Shown more clearly is the short barrel support 92 and the base bevel surface 94.

The Quick Loader 100 is preferably constructed of materials typically used for constructing rifles and their associated equipment. For example, certain parts of the quick loader 100, including the main cylinder 61, cylinder top plate 80, ramrod support structure 174, cylinder base plate 90 and short barrel support 92 are preferably made from walnut or some other suitable type of wood. The springs in the Quick Loader 100 are preferably made of steel, and the other components are preferably made from silicon bronze.

Operation of the Quick Loader

Operation of the Quick Loader 100 begins with the loading process. Assuming that the Quick Loader 100 is empty and in the un-cocked condition shown in FIG. 10, it is prepared for loading by pulling the pull button 172 to compress the ramrod spring 171 and retract the ramrod foot 179 toward the ramrod cavity 177. As the ramrod foot 179 passes into and through the lock hole 72, the ramrod foot 179 contacts the lock plate 74 and causes lock plate 74 to travel and the lock spring 76 to compress until the plate flanges 82*a,b* travel the length of the flange cavities 83*a,b*. Once the plate flanges 82*a,b* have traveled the length of the flange cavities 83*a,b*, the lock plate 74 is positioned such that the passing portion 84 of the lock hole 72 is in-line with the ramrod 170. Once the ramrod foot 179 passes through the passing portion 84 of the lock hole 72, the lock spring 76 expands and the lock plate 74 travels until the plate flanges 82*a,b* have traveled the length of the flange cavities 83*a,b*. Once the plate flanges 82*a,b* have traveled the length of the flange cavities 83*a,b*, the lock plate 74 is positioned such that the catching portion 85 of the lock hole 72 is in-line with the ramrod 170. Then the ramrod button 172 is released and the ramrod spring 171 forces the ramrod foot 179 toward the lock plate 74; the foot lip 178 catches on and is left resting on the lock plate 74 so that the Quick Loader 10 is in the cocked condition shown in FIG. 14.

Once the Quick Loader 100 is configured in the cocked condition shown in FIG. 14, it is turned upside down from the position shown in FIG. 14 so that the Quick Loader 100 is seen as shown in FIG. 21, and the storage cavity 62 that is aligned with the discharge cavity 64 is loaded by placing a lead ball 110, and then the appropriate amount of black powder 111, into the discharge cavity 64.

Another storage cavity 62 is then aligned with the discharge cavity 64 by pressing the indexer button 187 so that the indexer spring 184 is compressed and the indexer flange 188 disengages from a plate notch 192. Once the indexer flange 188 disengages from a plate notch 192, the main cylinder 61 is capable of being manually rotated. Once the main cylinder 61 is rotated slightly, the indexer button 187 is released so that the indexer spring 184 forces the indexer flange 188 to engage a plate sliding surface 191. As manual force is applied to the main cylinder 61 causing it to rotate, the indexer flange 188 slides along a plate sliding surface 191. The indexer flange 188 is forced by the indexer spring 184 to wedge into the first plate notch 192 that the indexer flange 188 encounters; this locks the main cylinder 61 until the indexer button 187 is pressed again. The plate notches 192 are oriented so that when the main cylinder 61 locks, the discharge cavity 64 is in-line with one of the storage cavities 62 of the plurality of storage cavities 62, and so that the discharge cavity 64 can be placed in-line with each storage cavity 62 of the plurality of storage cavities 64 individually. The ramrod cavity 177 is always in-line with the discharge cavity 64.

Figure 22:
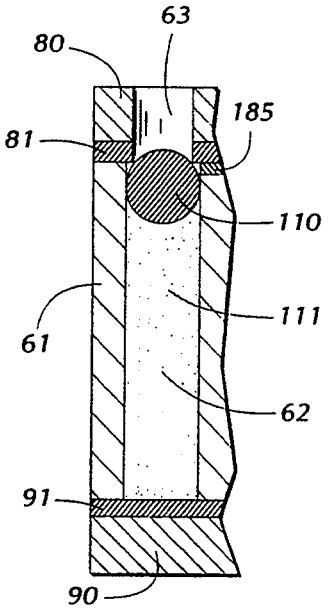
FIG. 22 is a cross-sectional, cut-away view of an isolated segment of the Quick Loader of FIG. 12, in the loaded condition.

Once another storage cavity 62 is aligned with the discharge cavity 64, that storage cavity 62 is loaded, and the process is repeated until all but one storage cavity 62 of the plurality of storage cavities 62 is loaded. FIG. 22 shows a cross-sectional cut-away view of one of the storage cavities 62 of the plurality of storage cavities 62 loaded with a lead ball 110 and black powder 111 in accordance with the preferred embodiment of the present invention. The storage cavity 62 that is not loaded is aligned with the ramrod cavity 177 and the ramrod 170 is released by pressing the lock button 73. Pressing the lock button 73 causes the lock spring to compress and the lock plate 74 to travel until the plate flanges 82*a,b* have traveled the length of the flange cavities 83*a,b*. Once the plate flanges 82*a,b* have traveled the length of the flange cavities 83*a,b*, the lock plate 74 is positioned such that the passing portion 84 of the lock hole 72 is in-line with the ramrod 170. Once the passing portion 84 is in this position, the ramrod spring 171 forces the ramrod foot 179 to pass through the empty storage cavity 62 that is in-line with the ramrod cavity 177 so that the ramrod assembly 169 is in the un-cocked condition shown in FIG. 13. Once in this condition the Quick Loader 100 can be conveniently carried until it is used.

Muzzle Loaded Rifle Loading System

The Muzzle Loaded Rifle Loading System comprises the combined apparatuses of the Quick Muzzle Loading Rifle 10 and the Quick Loader 100. The invented System also comprises a method of loading the Quick Muzzle Loading Rifle 10 with the Quick Loader 100.

Once the Quick Loader 100 is loaded, in the manner specified above, it is used to load the Quick Muzzle Loading Rifle 10. Just prior to loading, the Quick Loader 100 is prepared by pulling the pull button 172 to retract the ramrod 170 into the ramrod support structure 174. Then the pull button 172 is released so that the foot lip 178 contacts and rests on the lock plate 74 such that the ramrod assembly 169 is configured in a cocked condition as shown in FIG. 14.

After the Quick Loader 100 is cocked, it is mated to the Quick Muzzle Loading Rifle 10. In order to mate the Quick Muzzle Loading Rifle 10 with the Quick Loader 100, the rifle must be placed in the disengaged condition shown in FIG. 7 as specified above. The Quick Loader 100 is then mated with the Quick Muzzle Loading Rifle 10 so that the short barrel support 92 and the short barrel holder 93 (see FIGS. 13, 14, and 21) fit over the short barrel muzzle 57 (see FIGS. 7 and 9) and the base bevel surface 94 is in contact with the muzzle bevel 60 so that the short barrel bore 55 is in-line the discharge cavity 64, ramrod cavity 77, and a storage cavity 62. In the preferred embodiment, the barrel extension 13 and short barrel 50 are formed as having an octagonal cross section (as seen from end views—see FIG. 6). This is primarily for esthetics, and other cross-sectional shapes are acceptable in other embodiments. However, in accordance with the inventive concepts of the present invention, taking advantage of a non-circular cross-sectional shape of the short barrel 50, the short barrel support 92 of the Quick Loader 100 is shaped to cooperate (see FIG. 21) with the shape of the short barrel 50 so as to facilitate non-rotational mating between the Quick Loader 100 and the Quick Muzzle Loading Rifle 10.

Figure 23:
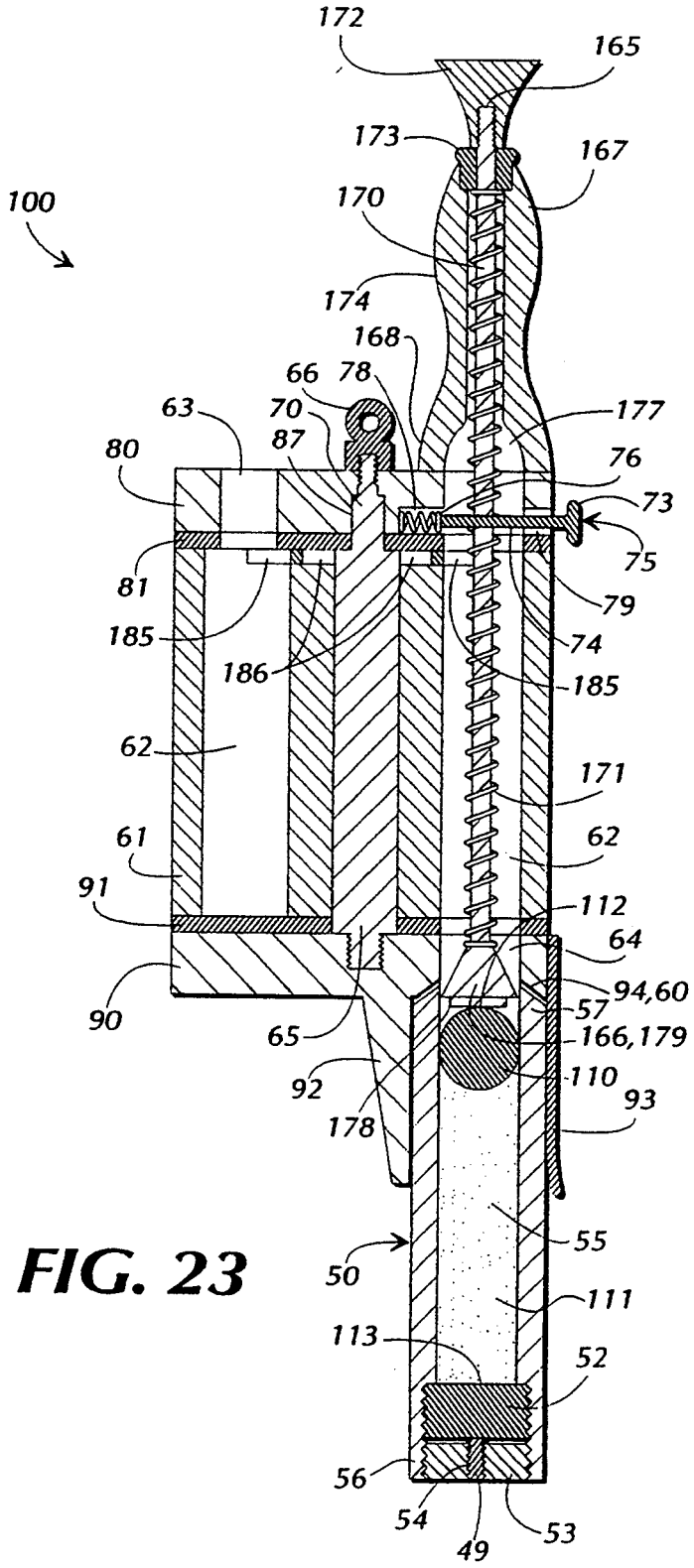
FIG. 23 is a cross-sectional view of the Quick Loader mated with a portion of the Quick Muzzle Loading Rifle in accordance with the preferred embodiment of the system.

Once the Quick Loader 100 and the Quick Muzzle Loading Rifle 10 are mated, the sight cavities 63 are viewed to determine which storage cavities 62 are loaded. Then the indexer lock 182 is operated and the main cylinder 61 is manually rotated to align a loaded storage cavity 62 with the discharge cavity 64. The lock button 73 is then pressed which causes the ramrod foot 179 to drive through the aligned storage cavity 62 causing the black powder 111 and the lead ball 110 from within the aligned storage cavity 62 to be properly loaded into the short barrel bore 55 such that the black powder 111 is properly encased in the short barrel bore 55 and the short barrel bore 55 is properly plugged by the lead ball 110 (see FIG. 23). In the preferred embodiment of the present invention, each storage cavity 62 of the plurality of storage cavities 62 is sized to a volume which defines a preferred "charge volume" and that "charge volume" is completely filled with the appropriate amount of black powder 111 and a lead ball 110. The short barrel 50 and the short barrel bore 55 are sized and formed such that, when the lead ball 110 is wedged into the short barrel bore 55 (the "wedged position") then the volume defined from the outer point 112 of the lead ball 110 to the inner most point 113 of the short barrel bore 55 is substantially the same as the "charge volume" (see FIG. 23). Preferably, the length of the ramrod 170 and the distance the ramrod 170 travels are configured so as to drive the lead ball 110 to the "wedged position".

Once the short barrel bore 55 is properly loaded, the Quick Loader 100 is removed from the Quick Muzzle Loading Rifle 10, the short barrel 50 is placed into the short barrel cavity 59, and the cam mechanism 40 is engaged. Once in this configuration, the Quick Muzzle Loading Rifle 10 is ready to fire in a manner that is common to conventional muzzle loading rifles that have been loaded. Once the Quick Muzzle Loading Rifle 10 is fired, it can be reloaded by the Quick Loader 100 in accordance with the above procedure with the contents of another storage cavity 62. This process can be repeated until each storage cavity 62 of the plurality of storage cavities 62 has been emptied; then the Quick Loader 100 must be reloaded in accordance with the above procedure.

While the embodiments of the present invention which have been disclosed herein are the preferred forms, other embodiments of the apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that the relative dimensions and relationships shown on the drawings are given as the preferred relative dimensions and relationships, but the scope of the invention is not to be limited thereby.

I claim:

1. A muzzle loaded firearm capable of discharging a projectile in response to the sparking of a powder charge, comprising:

a frame member;

a first barrel member mounted to said frame member, said first barrel member including, at least, an elongated body defining a first end, a second end, and an inner passage wall defining a passage formed lengthwise through said body and opening at said first end and said second end;

a second barrel member mounted to said frame member for movement between a ready position in alignment with said first barrel member and a load position out of alignment with said first barrel member, said second barrel member including, at least, a second barrel body defining a first end and a second end, a bore formed in said second barrel body and opening at said first end for accepting a charge of powder and a projectile, and a spark port formed in said second barrel body in communication between said bore and a source of sparking, said first barrel member and said second barrel member being mounted to said frame such that said second end of said first barrel member and said first end of said second barrel member are proximate to one another when said second barrel member is in said ready position; and a cam assembly for moving said second barrel member toward said first barrel member, wherein said cam assembly includes, at least, a cam pivotally mounted to said frame member and defining a cam lobe, a linkage member, wherein when said barrel member is in said ready position, said linkage member is disposed between said cam and said second end of said second barrel body, and pivot means for causing said cam to pivot relative to said second barrel member and said frame member in a first direction and a second direction, wherein said firearm is constructed and arranged so that when said second barrel member is in said ready position and said cam pivots in said first direction, said can lobe slidingly engages and applies a first force to said linkage member causing said linkage member to apply a second force to said second end of said second barrel body so that said cam assembly is in an engaged configuration in which said first end of said second barrel body is forced securely toward said second end of said first barrel body, and wherein said firearm is constructed and arranged so that when said second barrel member is in said ready position and said cam pivots in said second direction, said first force and said second force decrease, whereby said second barrel member is capable of moving to said load position.

2. Firearm of claim 1, wherein said pivot means includes, at least, a first member including, at least, a first end and a second end, wherein said first end of said first member is pivotally connected to said cam, and a second member including, at least, a midportion, a first end, and a second end, wherein said first end of said second member is pivotally connected to said second end of said first member, wherein said midportion of said second member is pivotally connected to said frame member, and wherein said firearm is constructed and arranged so that, when a user moves said second end of said second member, said second member pivots relative so said frame member and causes said cam to pivot relative to said frame member.

3. Firearm of claim 2, wherein said cam further defines a cam rear opposite from said cam lobe, and wherein said cam assembly further includes, at least, a cam lock for selectively locking said cam assembly in said engaged configuration, wherein said cam lock includes, at least, a lock wedge movably connected to said frame member, and a spring for biasing said lock wedge away from said frame member and into engagement with said cam rear when said cam assembly is in said engaged configuration.

4. A muzzle loaded firearm capable of discharging a projectile in response to the sparking of a powder charge, comprising:

a frame member;

a first barrel member mounted to said frame member, said first barrel member including, at least, an elongated body defining a first end and a second end, an inner passage wall defining a passage formed lengthwise through said body and opening at said first end and said second end, and rifling defined along said inner passage wall;

a second barrel member mounted to said frame member for movement between a ready position in alignment with said first barrel member and a load position out of alignment with said first barrel member, said second barrel member including, at least, a second barrel body, wherein said second barrel body defines a first end and a second end, wherein said second barrel body further defines a bore formed in said second barrel body and opening at said first end for accepting a charge of powder and projectile, wherein said bore is gradually tapered, whereby a first diameter defined by said bore at said first end of said second barrel body is greater than a second diameter defined by said bore at a position between said first end and said second end of said second barrel body, whereby a projectile inserted into said bore is capable of being wedged into said bore due to said taper, and wherein said second barrel body further defines a spark port formed in said second barrel body and in communication between said bore and a source of sparking, said first barrel member and said second barrel member being mounted to said frame such that said second end of said first barrel member and said first end of said second barrel member are adjacent to one another when said second barrel member is in said ready position;

a length adjustment means for adjusting the effective length of said second barrel, wherein said length adjustment means includes, at least, an adjuster member threadedly mounted to said second end of said second barrel body, whereby the adjuster member is screwed into or out of the second barrel body to thus vary the effective length of the second barrel body;

a mounting assembly by which said second barrel member is mounted to said frame, said mounting assembly including, at least, a barrel engaging member to which said second barrel member is attached, a barrel adjustment means for adjusting the orientation of said second barrel member relative to said barrel engaging member, whereby the alignment of said bore of said second barrel body is adjusted relative to said passage formed lengthwise through said elongated body of said first barrel member, and a hinge member mounted to said frame and about which said barrel engaging member pivots so as to facilitate said movement of said second barrel member between said ready position and said load position; and a means for moving said second barrel member toward said first barrel member.

5. A muzzle loaded firearm capable of discharging a projectile in response to the sparking of a powder charge, comprising:

a frame member;

a first barrel member mounted to said frame member, said first barrel member including, at least, an elongated body defining a first end and a second end, an inner passage wall defining a passage formed lengthwise through said body and opening at said first end and said second end;

a second barrel member mounted to said frame member for movement between a ready position in alignment with said first barrel member and a load position out of alignment with said first barrel member, wherein said second barrel member includes, at least, a second barrel body defining, at least, a first end and a second end, a charge receiving bore formed in said second barrel body and opening at said first end of said second barrel body for accepting a charge of powder and projectile, and a spark port formed in said second barrel body in communication between said charge receiving bore and a source of sparking, and wherein said first barrel member and said second barrel member are mounted to said frame such that said second end of said first barrel member and said first end of said second barrel member are proximate to one another when said second barrel member is in said ready position;

a means for moving said second barrel member toward said first barrel member; and a barrel length adjustment assembly for adjusting the effective length of said second barrel, wherein said barrel length adjustment assembly includes, at least, an adjuster member threadedly mounted to said second end of said second barrel body, wherein said adjuster member is screwed into or out of the second barrel body to vary the effective length of the second barrel body, and a set screw constructed and arranged to allow a user to selectively secure said adjuster member relative to said second barrel body.

6. Firearm of claim 5, wherein said second barrel body further defines, at least, a second bore formed in said second barrel body and opening at said second end of said second barrel body, wherein said adjuster member threads into and out of said second bore, wherein said adjuster member defines a adjustment bore therethrough, and wherein said set screw threads into and out of said adjustment bore

7. Firearm of claim 6, wherein said second bore includes, at least, a first end open at said second end of said second barrel body, and a second end disposed between said first end of said second barrel body and said second end of said second barrel body, wherein the firearm further includes, at least, a breech plug disposed in said second end of said second bore, and wherein said set screw extends through said adjustment bore defined in said adjustment member and engages said breech plug.

8. A muzzle loaded firearm capable of discharging a projectile in response to the sparking of a powder charge, comprising:

a frame member;

a first barrel member mounted to said frame member, said first barrel member including, at least, an elongated body defining a first end and a second end, an inner passage wall defining a passage formed lengthwise through said body and opening at said first end and said second end;

a second barrel member mounted to said frame member for movement between a ready position in alignment with said first barrel member and a load position out of alignment with said first barrel member, said second barrel member including, at least, a second barrel body defining a first end and a second end, a bore formed in said second barrel body and opening at said first end for accepting a charge of powder and projectile, and a spark port formed in said second barrel body in communication between said bore and a source of sparking, said first barrel member and said second barrel member being mounted to said frame such that said second end of said first barrel member and said first end of said second barrel member are proximate to one another when said second barrel member is in said ready position;

a means for moving said second barrel member toward said first barrel member; and a mounting assembly by which said second barrel member is mounted to said frame, said mounting assembly including, at least, a barrel engaging member to which said second barrel member is attached, a barrel alignment adjustment means for facilitating adjustment of the orientation of said second barrel member relative to said barrel engaging member, wherein said mounting assembly is so constructed and arranged that, when said second barrel member is in said ready position, said adjustment of the orientation of said second barrel member relative to said barrel engaging member adjusts the alignment of said bore of said second barrel body relative to said passage formed lengthwise through said elongated body of said first barrel member, and a hinge member mounted to said frame and about which said barrel engaging member pivots so as to facilitate said movement of said second barrel member between said ready position and said load position.

9. Firearm of claim 8, wherein said inner passage wall of said elongated body of said first barrel further defines, at least, a first centerline through said passage formed through said elongated body of said first barrel, wherein said second barrel body of said second barrel further defines, at least, a second centerline through said bore formed through said second barrel body, and wherein said hinge member and said barrel engaging member are so constructed and arranged that, said first centerline and said second centerline are substantially parallel when the firearm is in said load position, and said first centerline and said second centerline are collinear when the firearm is in said ready position.

10. Firearm of claim 9, further comprising a barrel length adjustment means the adjusting the effective length of said second barrel.

11. Firearm of claim 1, wherein said barrel alignment adjustment means includes, at least, a first screw means including, at least a head and a shaft extending from said head and threadedly engaged to said second barrel body at a position closer to said first end than said second end of said second barrel body, a first adjustment sleeve including, at least, a first end a second end, and defining a threaded outer surface and hollow passage therethrough, wherein said outer surface of said first adjustment sleeve is threadedly attached to said barrel engaging member such that said first end of said first attachment sleeve is capable of being extended from and retracted into said barrel engaging member, whereby said first end of said first attachment sleeve is capable of engaging said second barrel body at selected distances from said barrel engaging member, and wherein said head of said first screw means engages said second end of said first attachment sleeve and said shaft of said first screw means passes through said hollow passage through said first adjustment sleeve, whereby said second barrel body is adjustably attached to said barrel engaging member, a second screw means including, at least a head and a shaft extending from said head and threadedly engaged to said second barrel body at a position closer to said second end than said first end of said second barrel body, and a second adjustment sleeve including, at least, a first end a second end, and defining a threaded outer surface and hollow passage therethrough, wherein said outer surface of said second adjustment sleeve is threadedly attached to said barrel engaging member such that said first end of said second attachment sleeve is capable of being extended from and retracted into said barrel engaging member, whereby said first end of said second attachment sleeve is capable of engaging said second barrel body at selected distances from said barrel engaging member, and wherein said head of said second screw means engages said second end of said second attachment sleeve and said shaft of said second screw means passes through said hollow passage through said second adjustment sleeve, whereby said second barrel body is adjustably attached to said barrel engaging member.

12. A muzzle loaded firearm system comprising:

a muzzle loaded firearm capable of discharging a projectile in response to the sparking of a powder charge, comprising, at least, a frame member, a first barrel member mounted to said frame member, said first barrel member including, at least, an elongated body defining a first end and a second end, an inner passage wall defining a passage formed lengthwise through said body and opening at said first end and said second end, a second barrel member mounted to said frame member for movement between a ready position in alignment with said first barrel member and a load position out of alignment with said first barrel member, said second barrel member including, at least, a second barrel body defining a first end and a second end, a bore formed in said second barrel body and opening at said first end for accepting a charge of powder and projectile, and a spark port formed in said second barrel body in communication between said bore and a source of sparking, said first barrel member and said second barrel member being mounted to said frame such that said second end of said first barrel member and said first end of said second barrel member are proximate to one another when said second barrel member is in said ready position, a means for moving said second barrel member toward said first barrel member; and a mounting assembly by which said second barrel member is mounted to said frame, said mounting assembly including, at least, a barrel engaging member to which said second barrel member is attached, a barrel adjustment assembly for adjusting the orientation of said second barrel member relative to said barrel engaging member, whereby the alignment of said bore of said second barrel body is adjusted relative to said passage formed lengthwise through said elongated body of said first barrel member, wherein said barrel adjustment assembly includes, at least, a first screw means including, at least a head and a shaft extending from said head and threadedly engaged to said second barrel body at a position closer to said first end than said second end of said second barrel body, a first adjustment sleeve including, at least, a first end a second end, and defining a threaded outer surface and hollow passage therethrough, wherein said outer surface of said first adjustment sleeve is threadedly attached to said barrel engaging member such that said first end of said first attachment sleeve is capable of being extended from and retracted into said barrel engaging member, whereby said first end of said first attachment sleeve is capable of engaging said second barrel body at selected distances from said barrel engaging member, and wherein said head of said first screw means engages said second end of said first attachment sleeve and said shaft of said first screw means passes through said hollow passage through said first adjustment sleeve, whereby said second barrel body is adjustably attached to said barrel engaging member, a second screw means including, at least a head and a shaft extending from said head and threadedly engaged to said second barrel body at a position closer to said second end than said first end of said second barrel body, and a second adjustment sleeve including, at least, a first end a second end, and defining a threaded outer surface and hollow passage therethrough, wherein said outer surface of said second adjustment sleeve is threadedly attached to said barrel engaging member such that said first end of said second attachment sleeve is capable of being extended from and retracted into said barrel engaging member, whereby said first end of said second attachment sleeve is capable of engaging said second barrel body at selected distances from said barrel engaging member, and wherein said head of said second screw means engages said second end of said second attachment sleeve and said shaft of said second screw means passes through said hollow passage through said second adjustment sleeve, whereby said second barrel body is adjustably attached to said barrel engaging member, and a hinge member mounted to said frame and about which said barrel engaging member pivots so as to facilitate said movement of said second barrel member between said ready position and said load position.

a loading apparatus for interfacing with said muzzle loaded firearm, comprising, at least, a container body defining a first end, a second end, and a plurality of storage cavities having a first end and a second end, wherein said first end of each storage cavity of said plurality of storage cavities opens at said first end of said container and said second end of each storage cavity of said plurality of storage cavities opens at said second end of said container, a ramrod mechanism movably attached to said first end of said container body, capable of being aligned with each storage cavity of said plurality of storage cavities defined by said container body, and a container bottom movably attached to said second end of said container body, wherein said container bottom defines a connection means that attaches to said second barrel member and a cavity having a first end and a second end, wherein said first end of said cavity of said container bottom is capable of being aligned with each storage cavity of said plurality of storage cavities defined by said container body and second end of said cavity of said container bottom is capable of being aligned with said bore of said second barrel member.

13. A muzzle loaded firearm capable of discharging a projectile in response to the sparking of a powder charge, comprising:

a frame member;

a first barrel member mounted to said frame member, said first barrel member including, at least, an elongated body defining a first end and a second end, an inner passage wall defining a passage formed lengthwise through said body and opening at said first end and said second end;

a second barrel member mounted to said frame member for movement between a ready position in alignment with said first barrel member and a load position out of alignment with said first barrel member, said second barrel member including, at least, a second barrel body defining a first end and a second end, a bore formed in said second barrel body and opening at said first end for accepting a charge of powder and projectile, and a spark port formed in said second barrel body in communication between said bore and a source of sparking, said first barrel member and said second barrel member being mounted to said frame such that said second end of said first barrel member and said first end of said second barrel member are proximate to one another when said second barrel member is in said ready position;

a means for moving said second barrel member toward said first barrel member; and a loading apparatus for interfacing with said muzzle loaded firearm, said loading apparatus including, at least, a container body defining a first end, a second end, and a plurality of storage cavities for accepting a charge of powder and projectile, wherein each storage cavity of said plurality of storage cavities has a first end and a second end, and wherein said first end of each storage cavity of said plurality of storage cavities opens at said first end of said container body and said second end of each storage cavity of said plurality of storage cavities opens at said second end of said container body, a container bottom movably attached to said second end of said container body, wherein said container bottom defines a connection means for removable attachment to said second barrel member adjacent to said bore formed in said second barrel body, and wherein said container bottom defines a cavity having a first end and a second end, wherein said first end of said cavity of said container bottom is capable of being aligned with each storage cavity of said plurality of storage cavities defined by said container body and said second end of said cavity of said container bottom is capable of being aligned with said bore of said second barrel member, and a ramrod means movably attached to said first end of said container body for forcing a charge of powder and projectile from within a storage cavity of said plurality of storage cavities defined within said container body through said cavity defined within said container bottom and into said bore formed in said second barrel body when said connection means defined by said container bottom is attached to said second barrel member adjacent to said bore formed in said second barrel body, wherein said ramrod means includes, at least, a ramrod including, at least, a ramrod foot for engaging a charge of powder and projectile disposed within a storage cavity of said plurality of storage cavities defined within said container body, a ramrod support structure for supporting said ramrod and allowing selective movement of said ramrod, and a spring means for biasing said ramrod toward a position in which said ramrod foot is positioned closer to said second end of said container body than said first end of said container body.

14. Firearm of claim 13, wherein said ramrod means further includes, at least a lock means for securing said ramrod foot at a position above said first end of said container body and releasing said ramrod foot from said position above said first end of said container body, whereby said ramrod foot travels to a position in which said ramrod foot is positioned closer to said second end of said container body than said first end of said container body.

15. A muzzle loaded firearm capable of discharging a projectile in response to the sparking of a powder charge, comprising:

a frame member;

a first barrel member mounted to said frame member, said first barrel member including, at least, an elongated body defining a first end and a second end, an inner passage wall defining a passage formed lengthwise through said body and opening at said first end and said second end;

a second barrel member mounted to said frame member for movement between a ready position in alignment with said first barrel member and a load position out of alignment with said first barrel member, said second barrel member including, at least, a second barrel body defining a first end and a second end, a bore formed in said second barrel body and opening at said first end for accepting a charge of powder and projectile, and a spark port formed in said second barrel body in communication between said bore and a source of sparking, said first barrel member and said second barrel member being mounted to said frame such that said second end of said first barrel member and said first end of said second barrel member are proximate to one another when said second barrel member is in said ready position;

a means for moving said second barrel member toward said first barrel member;

a mounting assembly by which said second barrel member is mounted to said frame, said mounting assembly including, at least, a barrel engaging member to which said second barrel member is attached, a hinge member mounted to said frame and about which said barrel engaging member pivots so as to facilitate said movement of said second barrel member between said ready position and said load position, and a first spring disposed between and engaging said barrel engaging member and said frame member for biasing said barrel engaging member and said second barrel member to said load position, wherein said first spring is a coil spring and includes, at least, a first end, a midportion, and a second end, wherein said first spring is constructed and arranged so that said first spring has a tendency to uncoil, and said tendency to uncoil biases said barrel engaging member and said second barrel member to said load position, wherein said midportion of said first spring encircles said hinge member, wherein said first end of said first spring engages said frame member, and wherein said second end of said first spring engages said barrel engaging member.

16. Firearm of claim 15, wherein the firearm further comprises a second spring that is constructed and arranged to move said second barrel member rearward from said first barrel member, and wherein said second spring is a coil spring and includes, at least, a first end engaging said frame member, a second end engaging said barrel engaging member, and a midportion encircling said hinge member.

17. A muzzle loaded firearm system comprising:

a muzzle loaded firearm capable of discharging a projectile in response to the sparking of a powder charge, wherein said muzzle loaded firearm includes, at least, a frame member, a first barrel member mounted to said frame member, said first barrel member including, at least, an elongated body defining a first end, a second end, and an inner passage wall defining a passage formed lengthwise through said body and opening at said first end and said second end, a second barrel member mounted to said frame member for movement between a ready position in alignment with said first barrel member and a load position out of alignment with said first barrel member, said second barrel member including, at least, a second barrel body defining, at least, a first end, a second end, a bore formed in said second barrel body and opening at said first end for accepting a charge of powder and projectile, wherein said bore defines a bore volume when a projectile is wedged into said bore, said bore volume being defined by said bore in a region bounded by the portion of the projectile closest to said first end of said second barrel body and the portion of said bore closest to said second end of said second barrel body, and a spark port formed in said second barrel body in communication between said bore and a source of sparking, said first barrel member and said second barrel member being mounted to said frame such that said second end of said first barrel member and said first end of said second barrel member are proximate to one another when said second barrel member is in said ready position, and a means for moving said second barrel member toward said first barrel member; and a loading apparatus for interfacing with said muzzle loaded firearm, wherein said loading apparatus includes, at least, a container body defining a first end, a second end, and a plurality of storage cavities having a first end and a second end, wherein said first end of each storage cavity of said plurality of storage cavities opens at said first end of said container and said second end of each storage cavity of said plurality of storage cavities opens at said second end of said container, and wherein each storage cavity of said plurality of storage cavities defines a cavity volume that is substantially similar to said bore volume, a ramrod mechanism movably attached to said first end of said container body, capable of being aligned with each storage cavity of said plurality of storage cavities defined by said container body, a container bottom movably attached to said second end of said container body, wherein said container bottom defines a connection means that attaches to said second barrel member and a cavity having a first end and a second end, wherein said first end of said cavity of said container bottom is capable of being aligned with each storage cavity of said plurality of storage cavities defined by said container body, and wherein said second end of said cavity of said container bottom is capable of being aligned with said bore of said second barrel member, and a container top movably attached to said first end of said container body and defining a plurality of sight cavities therethrough, wherein the projectile is spherical and defines a projectile diameter, wherein each sight cavity of said plurality of a sight cavities is aligned with a storage cavity of said plurality of storage cavities defined by said container body, wherein each sight cavity of said plurality of sight cavities defines a diameter that is less than the projectile diameter, whereby the projectile is incapable of passing thorough each sight cavity of said plurality of sight cavities, wherein each storage cavity of said plurality of storage cavities defines a diameter that is slightly larger than the projectile diameter, whereby the projectile is capable of passing through each storage cavity of said plurality of sight cavities, and wherein said loading apparatus is constructed and arranged so that when said loading apparatus is inverted such that said container bottom is above said container top, and a projectile is deposited into a storage cavity of said plurality of storage cavities through said cavity defined in said container bottom, the projectile will travel through said storage cavity and become lodged in said storage cavity at said first end of said container body, whereby, when said storage cavity is subsequently filled with powder charge, the projectile will be held in place at said first end of said container body by the powder charge in said storage cavity, whereby the projectile will be capable of being observed through the sight cavity of said plurality of sight cavities associated with said storage cavity, and whereby the powder charge within said storage cavity will be substantially precluded from passing through said sight cavity.

* * * * *